US010358890B2

(12) United States Patent
Zhong et al.

(10) Patent No.: US 10,358,890 B2
(45) Date of Patent: Jul. 23, 2019

(54) WELLBORE SEALS WITH COMPLEX FEATURES THROUGH ADDITIVE MANUFACTURING

(71) Applicant: Halliburton Energy Services, Inc., Houston, TX (US)

(72) Inventors: Xiaoguang Zhong, Carrollton, TX (US); Nathan J. Harder, Powell, WY (US); Jack Gammill Clemens, Fairview, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 15/736,245

(22) PCT Filed: Aug. 31, 2015

(86) PCT No.: PCT/US2015/047767

§ 371 (c)(1),
(2) Date: Dec. 13, 2017

(87) PCT Pub. No.: WO2017/039619

PCT Pub. Date: Mar. 9, 2017

(65) Prior Publication Data

US 2018/0187509 A1 Jul. 5, 2018

(51) Int. Cl.
*E21B 33/12* (2006.01)
*E21B 33/128* (2006.01)

(52) U.S. Cl.
CPC ..... *E21B 33/1208* (2013.01); *E21B 33/128* (2013.01)

(58) Field of Classification Search
CPC ..... E21B 33/128; E21B 33/1208
See application file for complete search history.

(56) References Cited

U.S. PATENT DOCUMENTS 4,720,113 A * 1/1988 Hertz, Jr. ..... F16J 15/20 277/342
5,165,703 A * 11/1992 Morvant ..... E21B 33/1208 277/342

(Continued)

FOREIGN PATENT DOCUMENTS

WO 0220941 3/2002
WO 2012106758 8/2012

OTHER PUBLICATIONS

Halliburton Energy Services,Inc., "Evo-Trieve™ Bridge Plug", available online at www.halliburton.com, at least as early as Sep. 14, 2014, 2 pages.

(Continued)

*Primary Examiner* — Kristyn A Hall
(74) *Attorney, Agent, or Firm* — Kilpatrick Townsend & Stockton LLP

(57) ABSTRACT

A wellbore sealing device having an elastomeric element with complex features and associated additive manufacturing method is disclosed. The complex features can include voids such as isolated voids and undercut-like voids that cannot be reasonably produced using existing molding techniques (e.g., due physically impossible mold shapes or cost-prohibitive mold requirements). These complex features can alleviate stress and increase radial expansion of the elastomeric element in response to axial compression of the elastomeric element. Such elastomeric elements with complex features can be additively manufactured (e.g., through three dimensional printing). In some cases, the elastomeric elements can be additively manufactured directly on a tool, such as on an end plate or mandrel of a wellbore sealing device.

20 Claims, 14 Drawing Sheets

(56) References Cited

U.S. PATENT DOCUMENTS

| | | | |
|---|---|---|---|
| 5,941,313 | A | 8/1999 | Arizmendi |
| 2007/0029080 | A1 | 2/2007 | Moyes |
| 2007/0044977 | A1 | 3/2007 | Hendrickson et al. |
| 2007/0089877 | A1 | 4/2007 | Corre et al. |
| 2010/0071911 | A1 | 3/2010 | Carree et al. |
| 2010/0122821 | A1 | 5/2010 | Corre et al. |
| 2011/0037229 | A1 | 2/2011 | Clarke |
| 2011/0303421 | A1 | 12/2011 | Mickey |
| 2013/0320598 | A1 | 12/2013 | Atkins et al. |

OTHER PUBLICATIONS

Halliburton Energy Services,Inc., "Wireline and Perforating Services", available online at www.halliburton.com, at least as early as Jan. 2012, 18 pages.

Parker Hannifin Corporation , "Packer Elements", available online at parker.com, Nov. 2014, 4 pages.

International Patent Application No. PCT/US2015/047767, "International Search Report and Written Opinion", dated May 2, 2016, 16 pages.

* cited by examiner

WELLBORE SEALS WITH COMPLEX FEATURES THROUGH ADDITIVE MANUFACTURING

TECHNICAL FIELD

The present disclosure relates to oilfield operations generally and more specifically to wellbore sealing elements and the manufacture thereof.

BACKGROUND

In oilfield operations, an annulus, such as an annulus between a tubular and another tubular (e.g., a casing string) or an annulus between a tubular and a wellbore (e.g., a bare wellbore), can be sealed. Sealing an annulus can include fluidly sealing the annulus with or without a pressure differential on opposite sides of the seal. Substantial pressure differentials across a seal can induce failure of the seal and can result in substantial loss of time, money, and equipment, and can even result in harm to individuals. Additionally, expanding a wellbore seal can induce substantial deformation and internal stress on a sealing element, which can increase the chance of failure (e.g., due to breaking or tearing). The design of wellbore seals is thus limited in structure and material choice in order to minimize the chance of failure.

BRIEF DESCRIPTION OF THE DRAWINGS

The specification makes reference to the following appended figures, in which use of like reference numerals in different figures is intended to illustrate like or analogous components.

DETAILED DESCRIPTION

Figure 1:
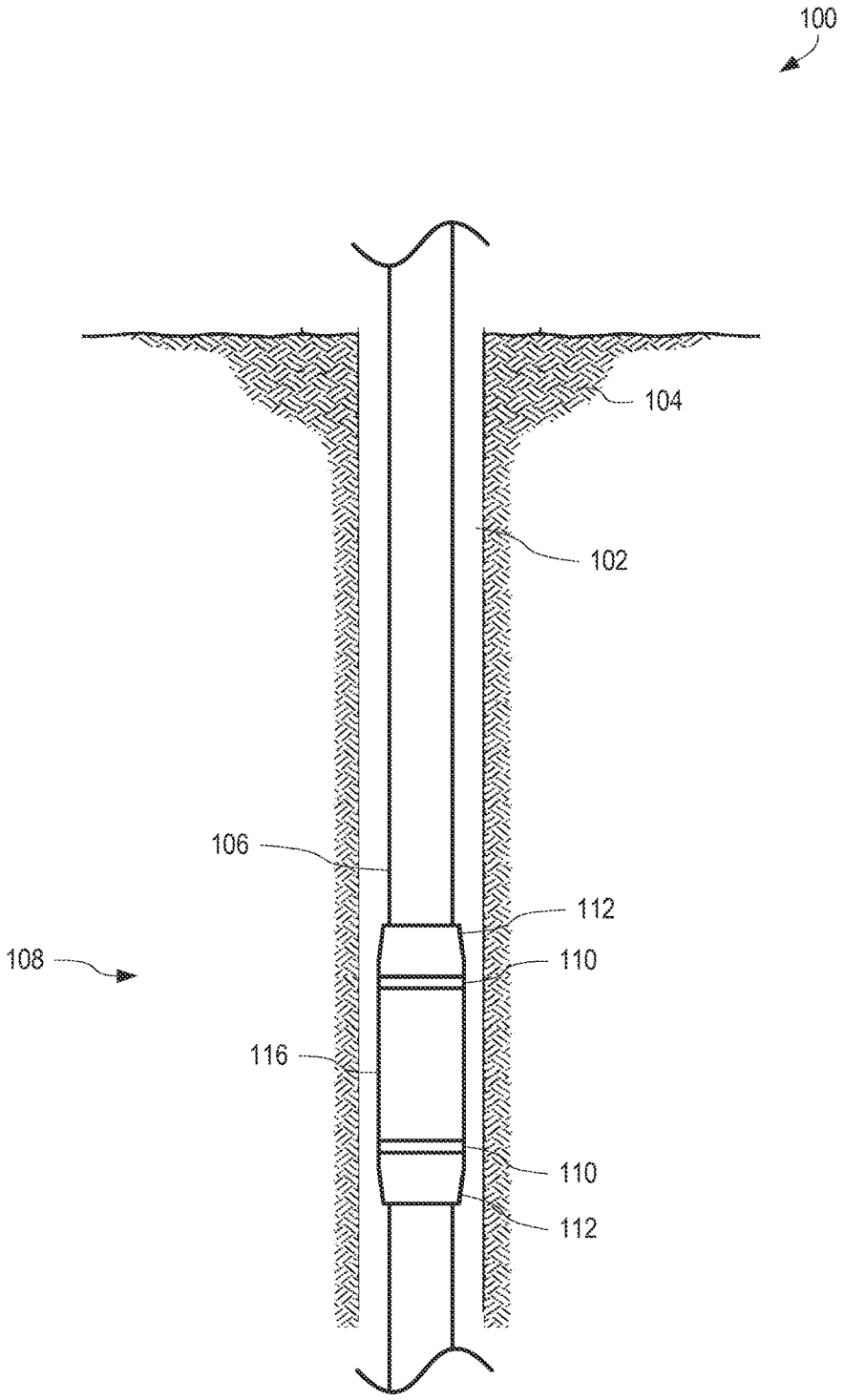
FIG. 1 is a schematic diagram of a wellbore servicing system that includes a wellbore sealing device in an uncompressed state according to certain aspects of the present disclosure.

Certain aspects and features of the present disclosure relate to a wellbore sealing device having an elastomeric element with complex features and the additive manufacturing thereof. The complex features can be considered non-moldable features. These features can include voids such as isolated voids and undercut-like voids that cannot be reasonably produced using existing molding techniques (e.g., due to physically impossible mold shapes or cost-prohibitive mold requirements). These complex features can alleviate stress and increase radial expansion of the elastomeric element in response to axial compression of the elastomeric element. Such elastomeric elements with complex features can be additively manufactured (e.g., through three-dimensional printing). In some cases, the elastomeric elements can be additively manufactured directly on a tool, such as on an end plate or mandrel of a wellbore sealing device.

Wellbore sealing devices can include elastomeric elements that expand radially while compressed axially. An elastomeric element can be supported between two end plates that can be used to impart axially compressive forces onto the elastomeric element. In use, the wellbore sealing device can be positioned at a desired location in a wellbore, and axial compressive forces can be applied to radially expand the elastomeric element in the wellbore. As the elastomeric element deforms, internal stresses can accumulate, which may lead to tearing, breaking, or other failure of the elastomeric element. Additionally, repeated compression and relaxation of an elastomeric element (e.g., when a wellbore sealing device is actuated and later removed) can result in similar failures due to repeatedly applied internal stresses. Internal stresses can be alleviated by using multiple elastomeric elements in conjunction with one another. The use of multiple elastomeric elements can make reclamation and reuse of the wellbore sealing device difficult, as well as increase manufacturing costs and design constraints associated with the wellbore sealing device.

Features incorporated into a single-piece elastomeric element can help alleviate internal stresses. Such features can include grooves, gaps, or other voids that allow portions of the elastomeric element to move somewhat freely with respect to other portions of the elastomeric element. For example, a void in an elastomeric element connected by a channel to an inner surface of the elastomeric element can function as a hinge, allowing a portion of the elastomeric element on one side of the hinge to move without pulling on the portion of the elastomeric element on the other side of the hinge. The efficacy of these features, however, can be limited by the geometry attainable through traditional manufacturing techniques, such as molding. For example, the hinge-type feature described above is a type of undercut that may require complex, removable mold elements for the elastomeric element to be removed from the mold itself. Such complex, removable mold elements can be impossible or impracticable to manufacture, being physically impossible to make, cost-prohibitive to make, or otherwise prohibitive to utilize. As used herein, the term "complex feature" or "non-moldable feature" can refer to a feature that is impossible to form using current molding technology or impracticable to form using current molding technology. Thus, an elastomeric element having complex features cannot be manufacture using current molding technology (e.g., due to impossibility or impracticability).

Wellbore sealing apparatuses can be manufactured with elastomeric elements having complex features through additive manufacturing techniques. Additive manufacturing techniques can involve applying material (e.g., elastomeric material) in a controlled fashion to build up and eventually form the final product (e.g., elastomeric element). Examples of additive manufacturing techniques include three-dimensional printing, fused filament fabrication, selective heat sintering, selective laser sintering, fused deposition modeling, or other techniques. Other additive manufacturing techniques can be used. Any suitable additive manufacturing technique can be used that is capable of forming the elastomeric element out of the desired elastomeric material or materials. Additive manufacturing can involve consecutively applying layers (e.g., layers of any width or length) of material Additive manufacturing can allow the elastomeric element to be formed with complex features that are impossible or impracticable to form using current molding technology. For example, a complex feature can be an internal void that is isolated from an inner surface or outer surface of the elastomeric element, or an internal void that is connected to a surface by a channel having a width that is smaller than the width of the void. An isolated internal void can be impossible to manufacture using molding techniques because the mold part that is required to create the negative space within the elastomeric element must be physically supported. The internal void connected by a channel having a width smaller than the width of the void is impossible or impracticable to manufacture using molding techniques, at least because the mold part required to create the negative space of the void would not be extractable through the thinner channel once the elastomeric element has solidified, or because the mold part would be impossibly or impracticably complex in order for it to be extracted.

Additive manufacturing can allow the elastomeric element to be formed on its own or directly onto a tool, such as a mandrel of a wellbore sealing apparatus. Traditionally molded elastomeric elements are positioned on parts of the wellbore sealing apparatus, and may need to be stretched to fit over certain parts (e.g., a hook of an end plate). In some examples, additive-manufactured elastomeric elements can be formed directly on the tool, and avoid being stretched over any parts of the tool. The tool can have features over which a molded elastomeric element may not be able to be stretched, while still being able to accept an elastomeric element that is formed thereon.

An additively-manufactured elastomeric element can have low expansion ratios (e.g., at or below 1.2:1) or high expansion ratios (e.g., above 1.3:1). The ability to form complex features within the elastomeric element can allow for elastomeric elements formed using any suitable materials to achieve high or low expansion ratios to withstand being deformed without tearing, breaking, or failure. Some examples of the subject matter described here can improve forming and using a single-piece elastomeric elements to achieve high-expansion ratios and retrievability.

Elastomeric elements according to some examples can be made of any suitable material or combination of materials, such as rubber, thermoplastic (e.g., with a glass-transition temperature higher than the operating temperature of the wellbore sealing device), or other nonmetallic material that can sustain large deformation. In some cases, metallic materials with sufficient ductility can be used. When metallic materials are used, ribs or spikes on the outer surface of the metallic elastomeric element or other surface variations can aid in creating a seal between the metallic elastomeric element and the surrounding tubular. The type of additive manufacturing technique can be selected, in part, based on the type of material used. In some cases, a combination of materials can be used, such as rubbers with different hardness values, or any combination of rubbers, thermoplastics, metallic, nonmetallic, or other deformable materials.

In some cases, for example with metallic elastomeric elements, complex features can include truss-like features that, when deformed, radially expand a portion or section of the elastomeric element outwards to create a seal.

In some cases, additive manufacturing can be used to form the elastomeric element, as well as other parts of the wellbore sealing device. For example, additive manufacturing can be used to form the mandrel (e.g., out of a metallic material) and the elastomeric element that surrounds part of the mandrel. The elastomeric element and other parts (e.g., a mandrel) can be formed in a single additive manufacturing process, or in separate additive manufacturing processes.

In some cases, an anti-extrusion device can be used to prevent the elastomeric element from extruding too far beyond the end plates of the elastomeric element. An anti-extrusion device can include petals that are capable of expanding and retracting, such as in response to the presence and absence of axially compressive force. The anti-extrusion device can be run downhole while in a retracted position. The anti-extrusion device can move into the expanded position, with its petals expanded, when axially compressive force is applied to the anti-extrusion device. Blocking plates can create a block for the elastomeric element, when the petals of the anti-extrusion device are expanded. This expansion action can reduce the extrusion gap through which the elastomer may extrude. This extrusion gap is the distance between the inner diameter of the tubular into which the wellbore sealing device is positioned and the outer diameter of the petals.

In some cases, the petals can include rollers, such as on the blocking plates or elsewhere. The rollers can be positioned adjacent to the inner diameter of the tubular into which the wellbore sealing device is positioned when the anti-extrusion device is expanded. The rollers can reduce friction of the anti-extrusion device against the tubular as the anti-extrusion device expands.

The use of additive manufacturing to produce parts of the wellbore sealing device can reduce the cost of tooling (e.g., preparing the molds that would be used to mold the elements of the wellbore sealing device, including the various molds necessary for different sized wellbore sealing devices). In some cases, additive manufacturing allows elements of a wellbore sealing device to be customized to particular measurements of a wellbore or other tubular. For example, a wellbore can be measured and those measurements can be used to determine the desired dimensions or complex features of an elastomeric element designed specifically for that particular wellbore.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative embodiments but, like the illustrative embodiments, should not be used to limit the present disclosure. The elements included in the illustrations herein may not be drawn to scale.

FIG. 1 is a schematic diagram of a wellbore servicing system 100 that includes a wellbore sealing device 108 in an uncompressed state according to certain aspects of the present disclosure. The wellbore sealing device 108 can include an elastomeric element 116 having complex features. The wellbore servicing system 100 also includes a wellbore 102 penetrating a subterranean formation 104 for the purpose of recovering hydrocarbons, storing hydrocarbons, disposing of carbon dioxide, or the like. The wellbore 102 can be drilled into the subterranean formation 104 using any suitable drilling technique. While shown as extending vertically from the surface in FIG. 1, in other examples the wellbore 102 can be deviated, horizontal, or curved over at least some portions of the wellbore 102. The wellbore 102 can be cased, open hole, contain tubing, and can include a hole in the ground having a variety of shapes or geometries.

A service rig (not shown), such as a drilling rig, a completion rig, a workover rig, or other mast structure or combination thereof can support the wellbore sealing device 108 in the wellbore 102, but in other examples a different structure can support the wellbore sealing device 108. The wellbore sealing device 108 can be further supported by a conveyance 106, which can be a wireline, slickline, cable, tubular (e.g. drill string, casing string, completion string, coiled tubing or the like), or other structure suitable for supporting the wellbore sealing device 108. In some aspects, a service rig can include a derrick (not shown) with a rig floor through which the conveyance 106 extends downward from the service rig into the wellbore 102. In an offshore situation, the service rig can be supported by risers or piers extending downwards to a seabed in some implementations. Alternatively, the service rig can be supported by columns sitting on hulls or pontoons (or both) that are ballasted below the water surface, which may be referred to as a semi-submersible platform or rig. In an off-shore location, tubing may extend from the service rig to exclude sea water and contain drilling fluid returns. Other mechanical mechanisms that are not shown may control the run-in and withdrawal of the conveyance 106 in the wellbore 102. Examples of these other mechanical mechanisms include a draw works coupled to a hoisting apparatus, a slickline unit or a wireline unit including a winching apparatus, another servicing vehicle, or other such mechanisms. The wellbore sealing device 108 can be a bridge plug, a packer, or another type of sealing device.

The wellbore sealing device 108 can include the elastomeric element 116 positioned between two end plates 110. In some cases, the elastomeric element 116 and end plates 110 are positioned between two anti-extrusion devices 112. As seen in FIG. 1, the wellbore sealing device 108 is in an uncompressed state and is able to be moved within the wellbore 102. Once located at a desired position, axial compression forces can be applied to the end plates 110 to axially compress the elastomeric element into a compressed state, as shown in FIG. 2.

Figure 2:
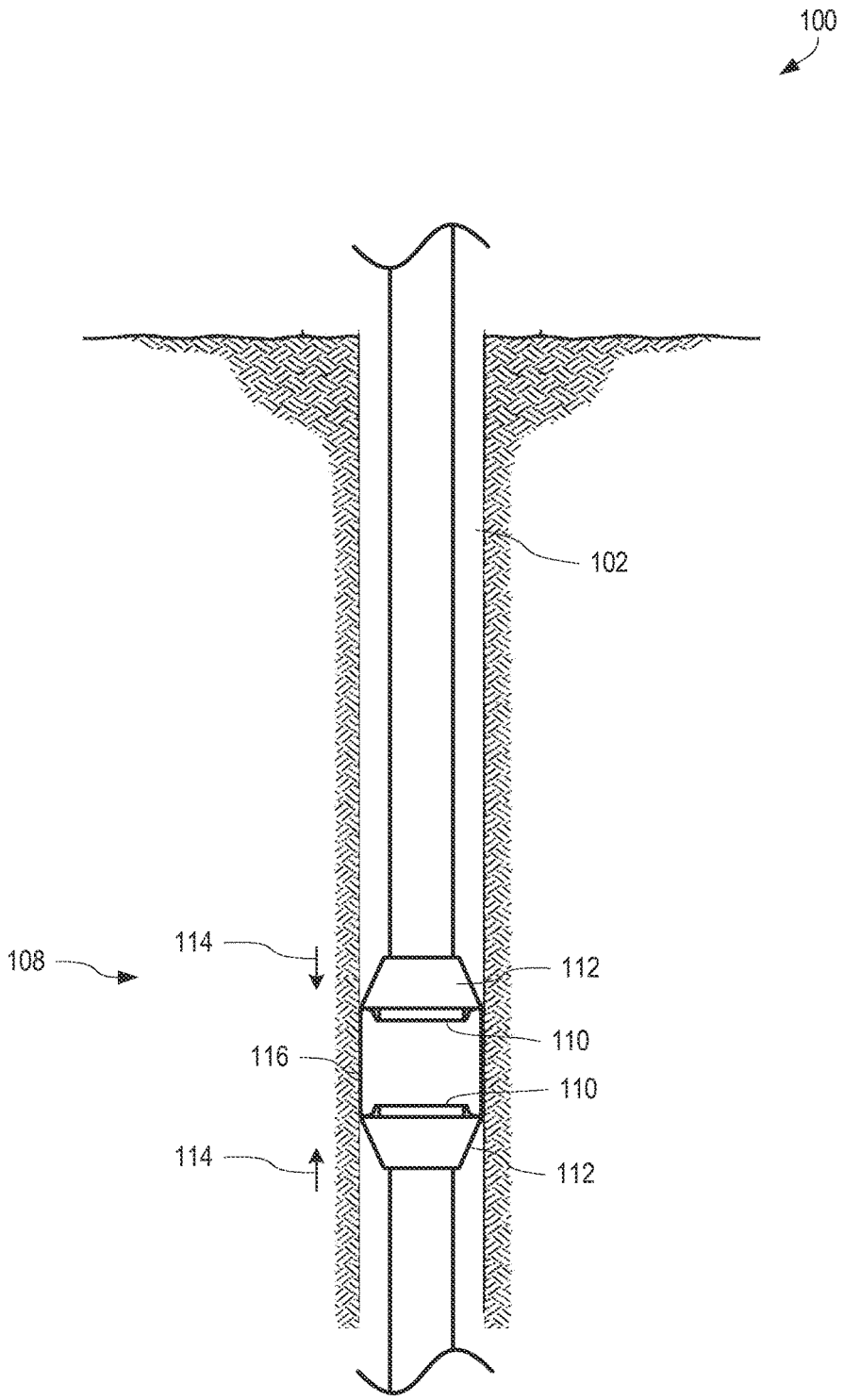
FIG. 2 is a schematic diagram of the wellbore servicing system of FIG. 1 including the wellbore sealing device in a compressed state according to certain aspects of the present disclosure.

FIG. 2 is a schematic diagram of the wellbore servicing system 100 of FIG. 1 including the wellbore sealing device 108 in a compressed state according to certain aspects of the present disclosure. Axially compressive force 114 is applied through the end plates 110 to the elastomeric element 116 to deform the elastomeric element 116 such that the elastomeric element 116 creates a seal in the wellbore 102. In cases where anti-extrusion devices 112 are used, the axially compressive force 114 can cause the anti-extrusion devices 112 to expand in diameter and provide a surface against which the deformable elastomeric element 116 cannot easily pass to prevent the elastomeric element 116 from deforming too far past the end plates 110.

In some cases, axially compressive forces 114 can be removed from—or axial extension forces can be applied to (e.g., in a direction opposite the axially compressive forces 114)—the wellbore sealing device 108 in order to return the wellbore sealing device 108 to an uncompressed state, such as that seen in FIG. 1.

The wellbore sealing device 108 can include an elastomeric element 116 that is an elastomeric element according to any of the examples disclosed herein, or other examples.

Figure 3:
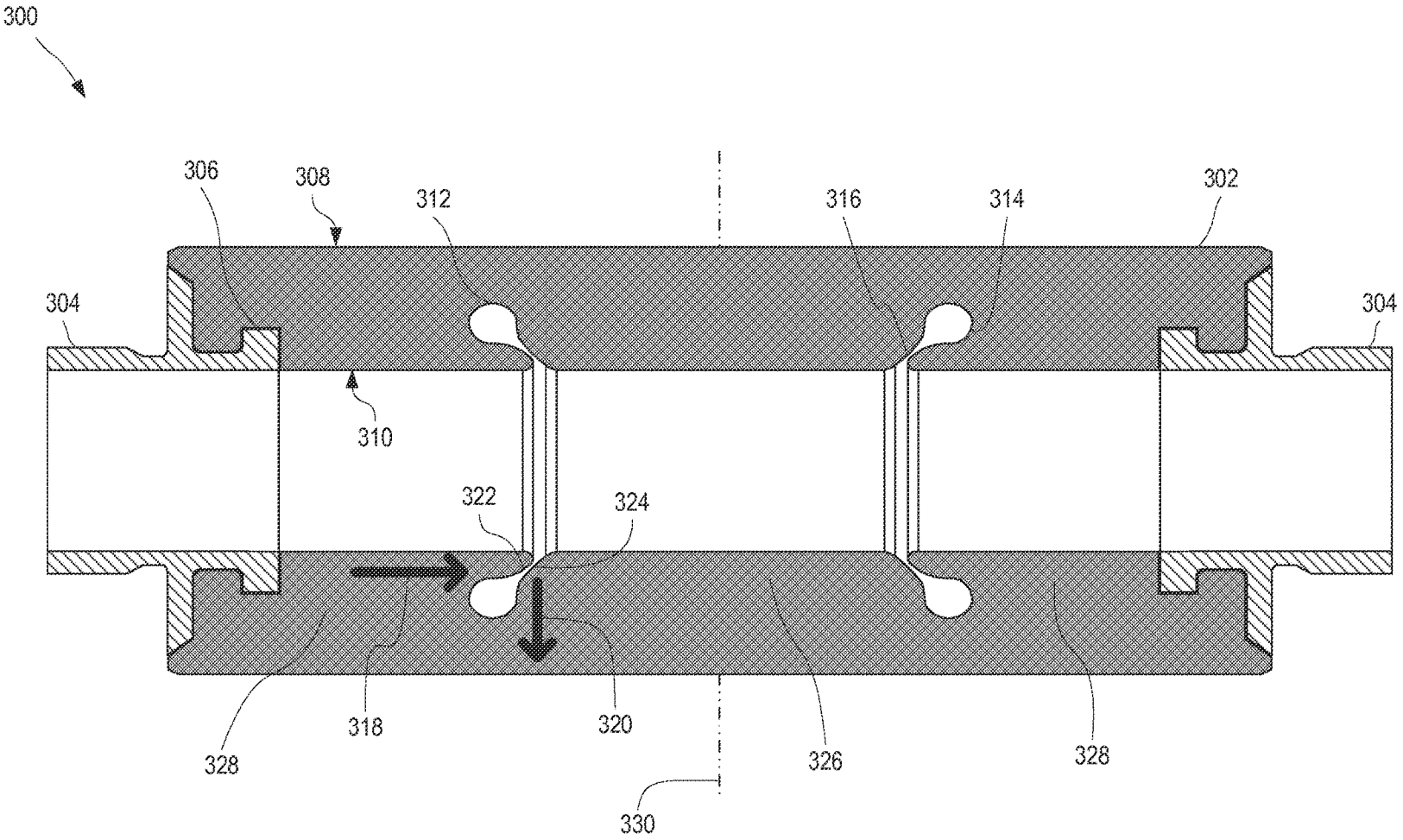
FIG. 3 is a cross-sectional diagram depicting a wellbore sealing device having an elastomeric element with two complex features according to certain aspects of the present disclosure.

FIG. 3 is a cross-sectional diagram depicting a wellbore sealing device 300 having an elastomeric element 302 with two complex features 312 according to certain aspects of the present disclosure. The wellbore sealing device 300 can include an elastomeric element 302 positioned between a pair of end plates 304. The end plates 304 can include a hook feature 306 that secures the elastomeric element 302 sufficiently for the end plate 304 to apply expansion forces (e.g., for the end plates 304 to pull on the elastomeric element 302). The elastomeric element 302 can include an inner surface 310 having an internal diameter and an outer surface 308 having an external diameter.

The complex features 312 can include internal voids 314 in the elastomeric element 302 that are connected to the inner surface 310 by a channel 316. In other cases, a channel 316 can connect a void 314 to an outer surface 308. The width of each void 314 can be greater than the width of the channel 316 connected to that void 314. In some cases, the width of a void 314 can be substantially greater than the width of the channel 316, such as by a factor of or greater than 2:1, 3:1, 4:1, 5:1, 6:1, 7:1, 8:1, 9:1, or 10:1.

The channel 316 connecting the void 314 can be oriented such that a line collinear with the channel 316 can extend from a center point of the elastomeric element 302 outwards. For example, in a top left quadrant of the elastomeric element 302 as shown in FIG. 3, the channel 316 is extending in a top-left to bottom-right direction (e.g., as opposed to a top-right to bottom-left direction). A channel 316 can connect a void 314 to either an inner surface 310 or an outer surface 308 of the elastomeric element 302. When the channel 316 connects to an inner surface 310, the channel 316 can be axially positioned between the void 314 and the central lateral axis 330 of the elastomeric element. When the channel 316 connects to an outer surface 308, the void 314 can be axially positioned between the channel 316 and the central lateral axis 330 of the elastomeric element.

The orientation of the channel 316 can be positioned to create an inclined plane capable of converting axially compressive force 318 into outwards radial force 320. This axial-to-radial conversion can be enhanced by having thinner channels 316. If the channel width is too large, the effect of the axial-to-radial conversion can be reduced or eliminated entirely. Each channel 316 can have a first face 322 and a second face 324. Due to the orientation of the channel 316, the first face 322 and the second face 324 can be shaped similar to inclined planes. As axially compressive force 318 is applied to the elastomeric element 302, the first face 322 can press against the inclined plane of the second face 324 to generate a certain amount of radial force 320. As a first portion 328 of the elastomeric element 302 is being forced in an axial direction, it can cause a second portion 326 of the elastomeric element 302 to be forced in a radial direction. The thin shape and orientation of the channel 316 can guide the first portion 328 underneath the second portion 326 during axial compression.

Additionally, because of the position and size of the void 314 and the channel 316, the complex feature 312 may reduce stress in portions of the elastomeric element 302 during compression. The complex feature 312 can act as a hinge. In an example, during axial compression, the complex feature 312 can allow the second portion 326 to deform in a radially outward direction without pulling as much on the first portion 328. Other stresses can be avoided through the use of complex features 312.

Figure 4:
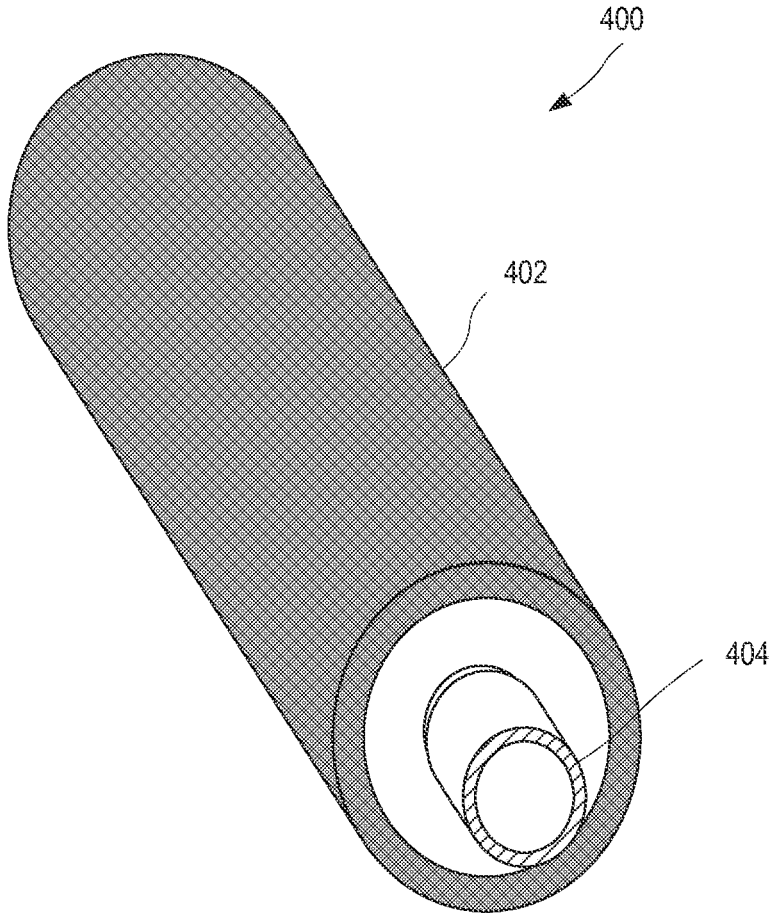
FIG. 4 is a axonometric view depicting a wellbore sealing device having an elastomeric element with complex features according to certain aspects of the present disclosure.

FIG. 4 is an axonometric view depicting a wellbore sealing device 400 having an elastomeric element 402 with complex features according to certain aspects of the present disclosure. The wellbore sealing device 400 can be a wellbore include an elastomeric element 402 positioned between a pair of end plates 404. The elastomeric element 402 can be elastomeric element 302 of FIG. 3, or another elastomeric element. Due to the cylindrical nature of the elastomeric element 402, it can be difficult to form complex features in the elastomeric element 402 using molding techniques.

Figure 5:
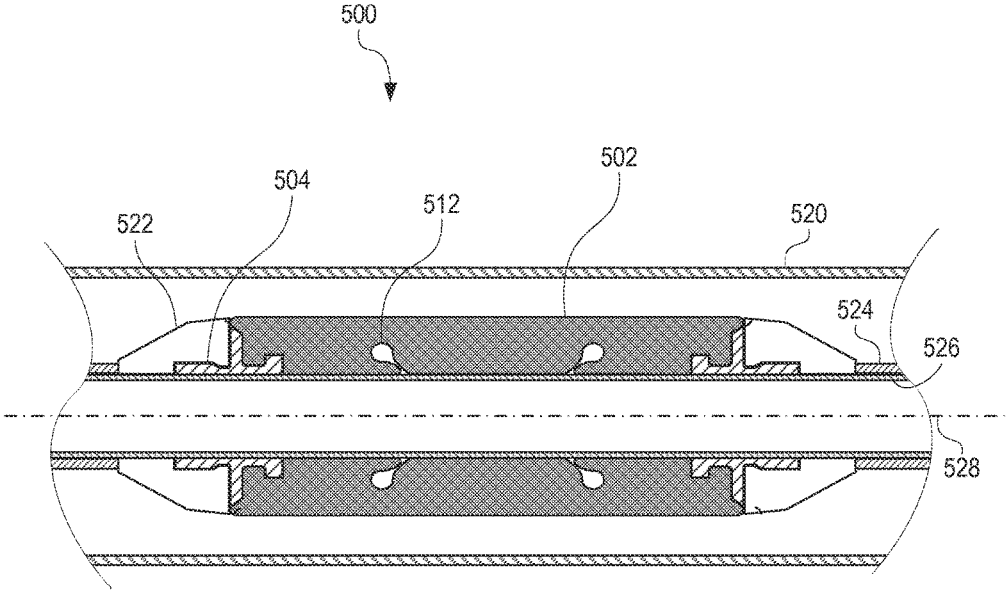
FIG. 5 is a cross-sectional diagram depicting a wellbore sealing device in an uncompressed state positioned within a tubular according to certain aspects of the present disclosure.

FIG. 5 is a cross-sectional diagram depicting a wellbore sealing device 500 in an uncompressed state positioned within a tubular 520 according to certain aspects of the present disclosure. The tubular 520 can be any suitable tubular, such as a wellbore, a casing string, or a downhole tool. The wellbore sealing device 500 can include an elastomeric element 502 with two complex features 512 similar to the complex features 312 of FIG. 3, although the elastomeric element 502 can include other numbers and types of complex features 512. The wellbore sealing device 500 can include an elastomeric element 502 positioned between a pair of end plates 504. A pair of anti-extrusion device 522, shown schematically, can be located adjacent to the end plates 504, opposite the elastomeric element 502. The anti-extrusion devices 522 can be in a closed state, but upon application of axial compressive force, can actuate into an open state.

A mandrel 526 can be located within an inner diameter of the elastomeric element 502 such that the elastomeric element 502 fits around the mandrel 526. The mandrel 526 can provide support to the elastomeric element 502 during axial compression to keep the elastomeric element 502 from deforming radially inwards (e.g., towards a central longitudinal axis 528). The mandrel 526 can have an inner diameter, but in other examples it does not. The annulus that is sealable by the wellbore sealing device 500 can be the annulus between the outer diameter of the mandrel 526 and the inner diameter of the surrounding tubular 520.

When in an uncompressed state, the wellbore sealing device 500 can move freely within the tubular 520. To move the wellbore sealing device 500 into a compressed state, and seal the tubular 520, axial force (e.g., force applied towards the elastomeric element 502 parallel a longitudinal axis 528 of the elastomeric element 502) can be applied. Axial force can be applied through the end plates 504. In some cases, axial force can be applied through an axial compression tool 524. The axial compression tool 524 can be any tool capable of inducing axial compressive forces in the wellbore sealing device 500. The axial compression tool 524 can include a linear actuator positioned in the wellbore (e.g., adjacent to the wellbore sealing device 500 or not adjacent to the wellbore sealing device) or external to the wellbore. When not positioned adjacent to the wellbore sealing device 500, the axial compression tool 524 can include a tubular for conveying the axial compressive forces to the wellbore sealing device 500. When axial compressive force is applied, the elastomeric element 502 can be compressed, as shown in FIG. 6.

Figure 6:
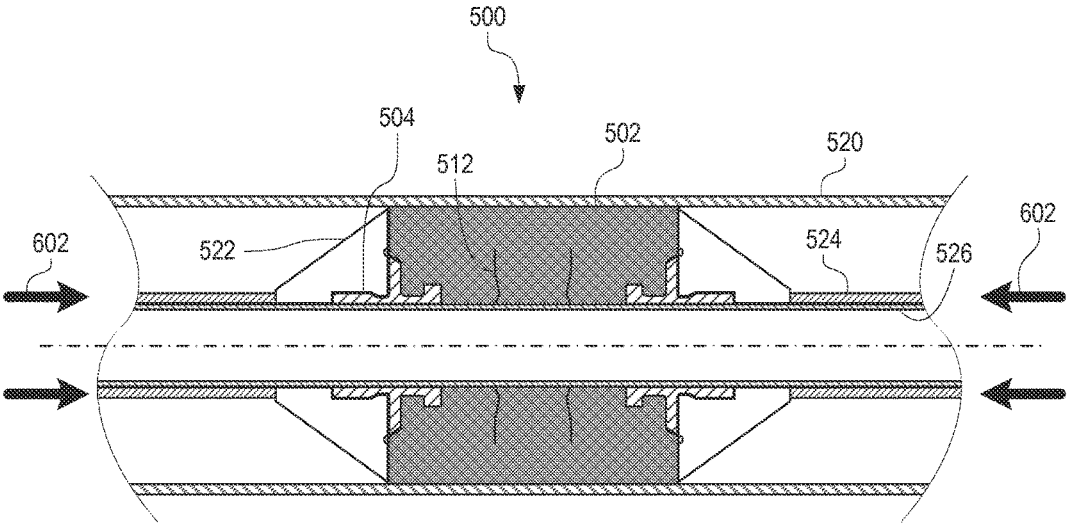
FIG. 6 is a cross-sectional diagram depicting the wellbore sealing device of FIG. 5 in a compressed state according to certain aspects of the present disclosure.

FIG. 6 is a cross-sectional diagram depicting the wellbore sealing device 500 of FIG. 5 in a compressed state (e.g., a set state) according to certain aspects of the present disclosure. Axial compressive force 602 is applied to the wellbore sealing device 500, such as from the axial compression tool 524 and through end plates 504.

The axial compressive force 602 causes the elastomeric element 502 to deform. Upon deformation, the complex features 512 can inhibit stress from accumulating by acting as a hinge, allowing portions of the elastomeric element 502 to move partially independently of one another. For example, the void and channel of a complex feature 512 can act as a hinge, allowing portions of the elastomeric element 502 immediately adjacent to the complex feature 512 on opposite sides of the complex feature 512 to move independently of one another except for where they are joined (e.g., beyond the complex feature 512). The complex features 512 shown in FIG. 5 allow the central portion of the elastomeric element 502 to move radially outward without inducing much stress on the end portions of the elastomeric element 502, when axial compressive forces 602 are applied. Additionally, the shape of the complex features 512 can help induce radial forces in response to the axially compressive forces 602. After deformation, the complex features 512 can be fully compressed, leaving no voids or channels except a wrinkle in the elastomeric element.

As shown in FIG. 6, the anti-extrusion devices 522 are extended in response to the axially compressive forces 602. The anti-extrusion devices 522 can help reduce the gap between the end plates 504 and the tubular 520, inhibiting extrusion or deformation of the elastomeric element 502 too far beyond the end plates 504.

When in a compressed state, the elastomeric element 502 can expand in outer diameter sufficiently to seal the tubular 520, such as by filling the annulus between the mandrel 526 and the tubular 520. Elastomeric elements having complex features, such as elastomeric element 502, can provide superior sealing power such that a seal can be held against higher pressure differentials than seals with elastomeric elements not having complex features. In some cases, elastomeric elements with complex features can withstand greater axial compressive forces 602 than elastomeric elements not having complex features.

Figure 7:
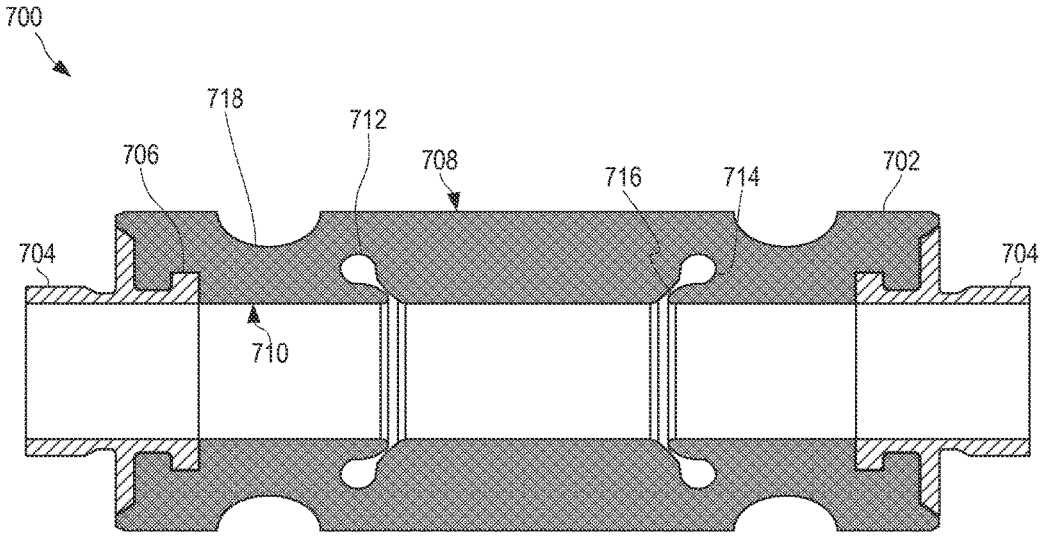
FIG. 7 is a cross-sectional diagram depicting a wellbore sealing device having an elastomeric element with two complex features positioned adjacent to external grooves according to certain aspects of the present disclosure.

FIG. 7 is a cross-sectional diagram depicting a wellbore sealing device 700 having an elastomeric element 702 with two complex features 712 positioned adjacent to external grooves 718 according to certain aspects of the present disclosure. The wellbore sealing device 700 can include an elastomeric element 702 positioned between a pair of end plates 704. The end plates 704 can include a hook feature 706 that secures the elastomeric element 702 sufficiently for the end plate 704 to apply expansion forces (e.g., for the end plates 704 to pull on the elastomeric element 702). The elastomeric element 702 can include an inner surface 710 having an internal diameter and an outer surface 708 having an external diameter.

The complex features 712 can be similar to the complex features 312 of FIG. 3 or as described elsewhere herein. The complex features 712 can be positioned such that the void 714 of the complex feature 712 is adjacent to a groove 718. The channel 716 of the complex feature 712 can extend away from the void 714 and in a direction away from the groove 718, such that the channel 716 connects the void 714 to the inner surface 710 of the elastomeric element 702. The groove 718 and void 714 being adjacent to one another can create an intentional folding zone that enhances the hinge-like abilities of the complex feature 712.

The grooves 718 can be of any geometry and position, potentially being complex features themselves.

Figure 8:
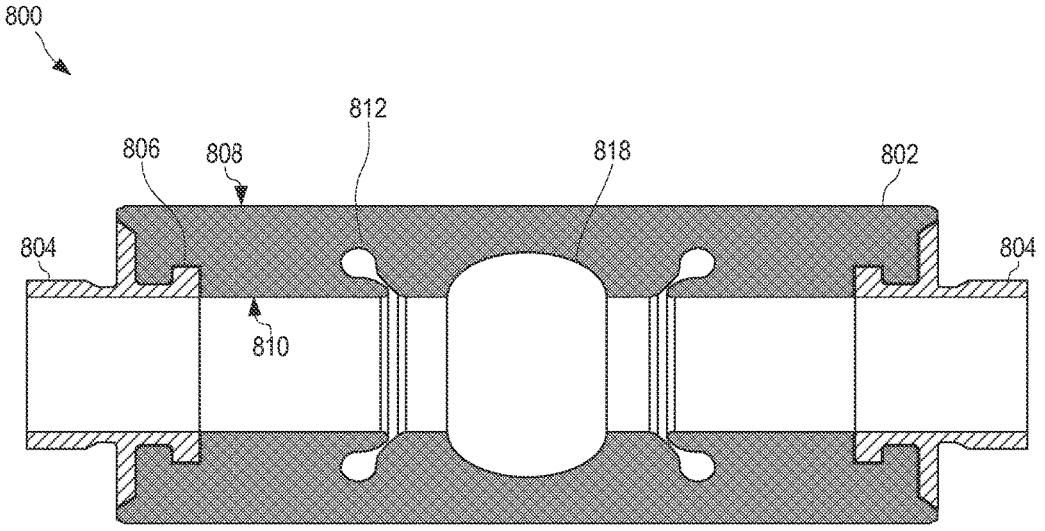
FIG. 8 is a cross-sectional diagram depicting a wellbore sealing device having an elastomeric element with two complex features and a central recess according to certain aspects of the present disclosure.

FIG. 8 is a cross-sectional diagram depicting a wellbore sealing device 800 having an elastomeric element 802 with two complex features 812 and a central recess 818 (e.g., undercut) according to certain aspects of the present disclosure. The wellbore sealing device 800 can include an elastomeric element 802 positioned between a pair of end plates 804. The end plates 804 can include a hook feature 806 that secures the elastomeric element 802 sufficiently for the end plate 804 to apply expansion forces (e.g., for the end plates 804 to pull on the elastomeric element 802). The elastomeric element 802 can include an inner surface 810 having an internal diameter and an outer surface 808 having an external diameter.

The complex features 812 can be similar to the complex features 312 of FIG. 3 or as described elsewhere herein. The elastomeric element 802 can additionally include a central recess 818. The central recess 818 can induce buckling or folding of the elastomeric element 802 at a desired location, specifically at the precipice of the central recess 818. The central recess 818 can be of any geometry and position, potentially being a complex feature itself. In some cases, a floating piece can be positioned within the central recess 818 when the elastomeric element 802 is positioned about a mandrel. In some cases, as described herein, the elastomeric element 802 can be additively manufactured directly on a mandrel, and the central recess 818 can be left empty or can be filled with an integral part of the mandrel, a separate floating piece, or an additively manufactured floating piece that is additively manufactured when the elastomeric element 802 is manufactured (e.g., immediately before).

Figure 9:
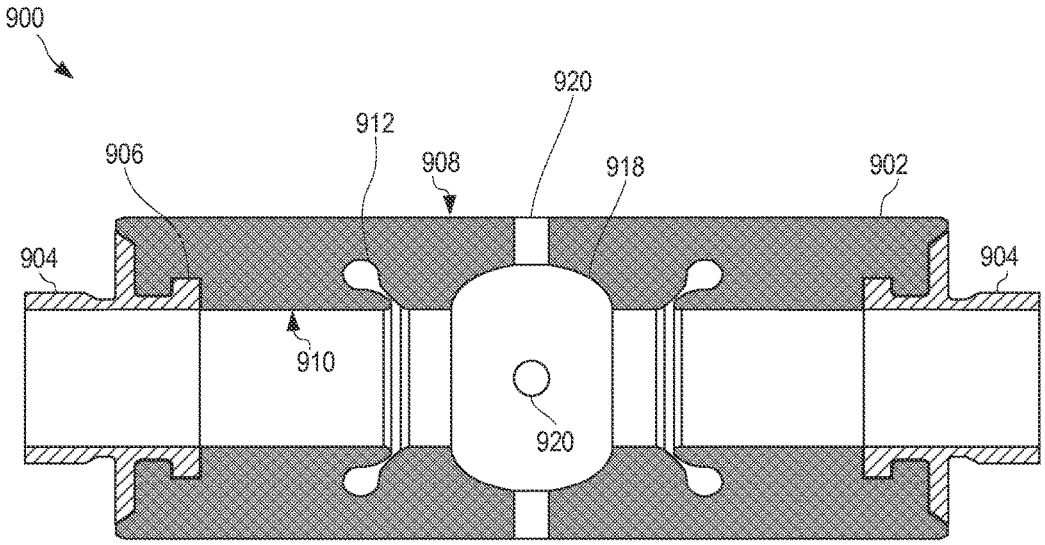
FIG. 9 is a cross-sectional diagram depicting a wellbore sealing device having an elastomeric element with two complex features and a central recess and fluid communication ports according to certain aspects of the present disclosure.

FIG. 9 is a cross-sectional diagram depicting a wellbore sealing device 900 having an elastomeric element 902 with two complex features 912 and a central recess 918 and fluid communication ports 920 according to certain aspects of the present disclosure. The wellbore sealing device 900 can include an elastomeric element 902 positioned between a pair of end plates 904. The end plates 904 can include a hook feature 906 that secures the elastomeric element 902 sufficiently for the end plate 904 to apply expansion forces (e.g., for the end plates 904 to pull on the elastomeric element 902). The elastomeric element 902 can include an inner surface 910 having an internal diameter and an outer surface 908 having an external diameter. The elastomeric element can have complex features 912 and a central recess 918 similar to those of the elastomeric element 802 of FIG. 8.

Fluid communication ports 920 can be incorporated into the elastomeric element 902. The fluid communication ports 920 can allow fluid to be squeezed out during axial compression. For example, axial compress, and thus radial movement of the center portion of the elastomeric element 902, can induce a low pressure zone that draws fluid into a space between the elastomeric element 902 and a mandrel about which the elastomeric element 902 is positioned. This fluid collection can be detrimental to the function and life of the wellbore sealing apparatus. The fluid communication ports 920 can allow this fluid to be squeezed out during the axial compression. When the elastomeric element 902 has been fully compressed, the fluid communication ports 920 can be fully flattened.

In some cases, the fluid communication ports 920 can themselves be complex features. For example, the fluid communication ports 920 can be tapered or otherwise shaped (e.g., lofted) such that their diameters at the inner surface 910 or outer surface 908 of the elastomeric element 902 is smaller than their diameters within the elastomeric element 902.

The elastomeric element 902 of FIG. 9 can include four fluid communication ports 920 equally spaced within a single plane. In other cases, any number of fluid communication ports, in the same or different planes, can be positioned in any orientation.

Figure 10:
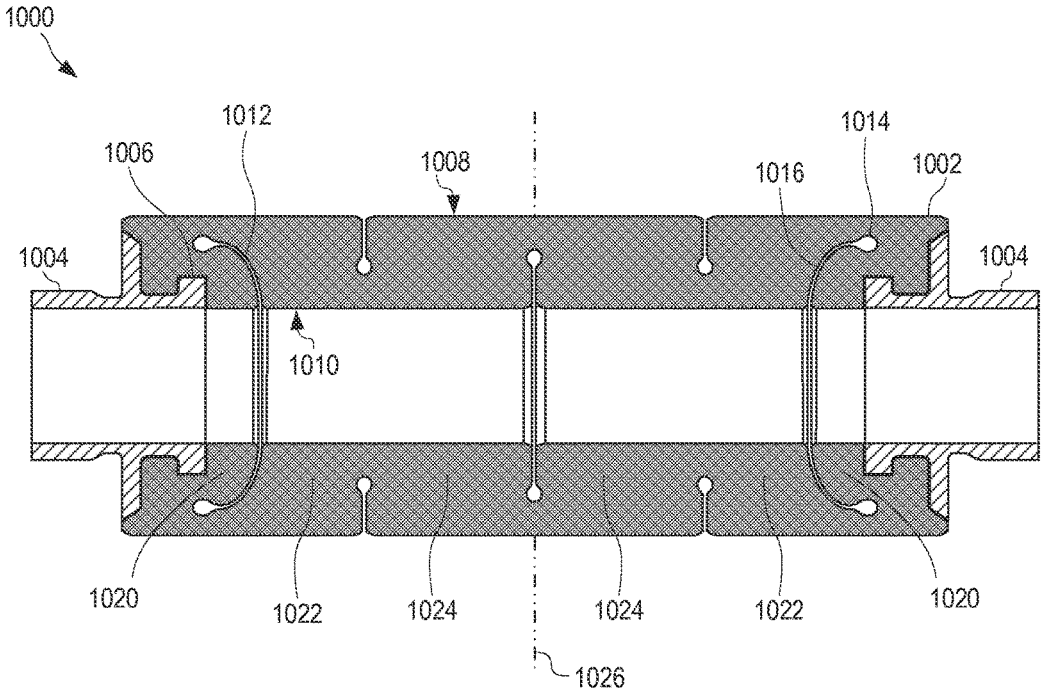
FIG. 10 is a cross-sectional diagram depicting a wellbore sealing device having an elastomeric element with five complex features according to certain aspects of the present disclosure.

FIG. 10 is a cross-sectional diagram depicting a wellbore sealing device 1000 having an elastomeric element 1002 with complex features 1012 according to certain aspects of the present disclosure. The wellbore sealing device 1000 can include an elastomeric element 1002 positioned between a pair of end plates 1004. The end plates 1004 can include a hook feature 1006 that secures the elastomeric element 1002 sufficiently for the end plate 1004 to apply expansion forces (e.g., for the end plates 1004 to pull on the elastomeric element 1002). The elastomeric element 1002 can include an inner surface 1010 having an internal diameter and an outer surface 1008 having an external diameter.

The elastomeric element 1002 can include complex features 1012 similar to the complex features 312 of the elastomeric element 302 of FIG. 3, including voids 1014 and channels 1016. The complex features 1012 of the elastomeric element 1002 can effectively separate the elastomeric element 1002 into several portions, such as outermost portions 1020, middle portions 1022, and inner portions 1024. As the elastomeric element 1002 undergoes axially compressive force, the curved nature of the complex features 1012 between the outermost portions 1020 and the middle portions 1022 can proportionally reduce stress around the elastomeric element 1002 near the ends of the elastomeric element 1002 (e.g., adjacent to the end plates 1004). The curved complex features 1012 can be located anywhere within the elastomeric element 1002. Under axially compressive force, the outermost portions 1020 can be forced towards the center 1026 of the elastomeric element 1002, while the middle portions 1022 and inner portions 1024 are forced radially outwards.

The presence of a complex feature 1012 at or near the center 1026 of the elastomeric element 1002 can replace a larger central recess (e.g., central recess 918 of FIG. 9). The elastomeric element 1002 can thus be formed to buckle at a desired location (e.g., at the center 1026 of the elastomeric element 1002) without having to be formed with a large void (e.g., a center recess), but instead being formed with a relatively small void 1014 and channel 1016. In other words, the elastomeric element 1002 can contain more material while still being able to buckle at a desired location (e.g., due to the hinge-type effect of the complex feature 1012).

Complex features 1012 can be positioned at any suitable location within the elastomeric element 1002. Axially adjacent complex features 1012 can include respective channels 1016 that connect their respective voids 1014 to opposite surfaces (e.g., inner surface 1010 or outer surface 1008) of the elastomeric element 1002.

Figure 11:
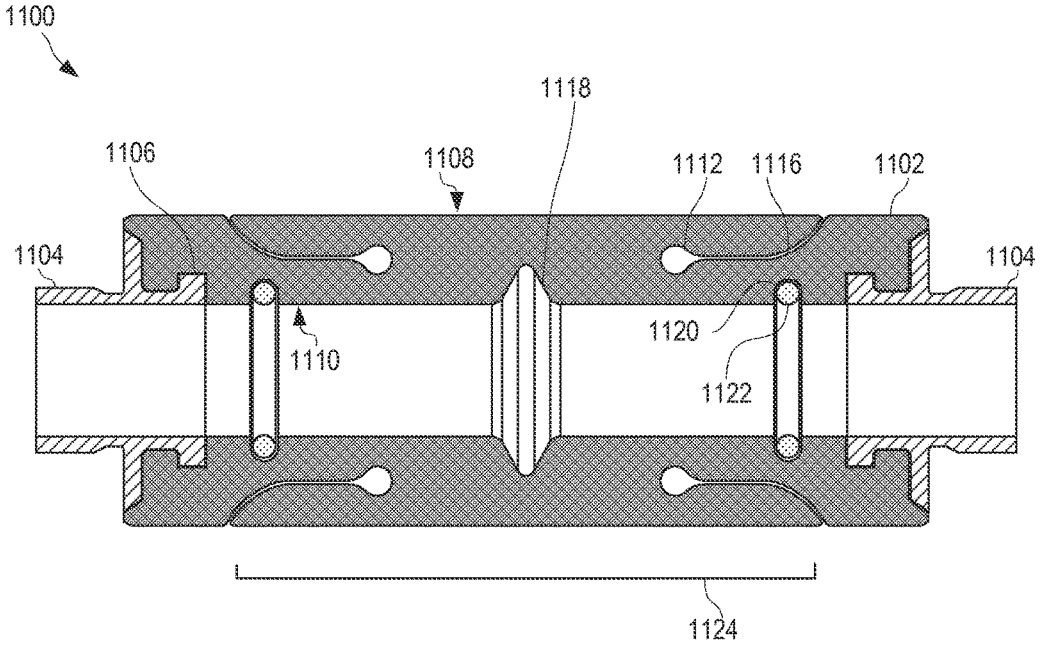
FIG. 11 is a cross-sectional diagram depicting a wellbore sealing device having an elastomeric element with two complex features, a central recess, and two internal seals according to certain aspects of the present disclosure.

FIG. 11 is a cross-sectional diagram depicting a wellbore sealing device 1100 having an elastomeric element 1102 with two complex features 1112, a central recess 1118, and two inner seals 1122 according to certain aspects of the present disclosure. The wellbore sealing device 1100 can include an elastomeric element 1102 positioned between a pair of end plates 1104. The end plates 1104 can include a hook feature 1106 that secures the elastomeric element 1102 sufficiently for the end plate 1104 to apply expansion forces (e.g., for the end plates 1104 to pull on the elastomeric element 1102). The elastomeric element 1102 can include an inner surface 1110 having an internal diameter and an outer surface 1108 having an external diameter.

The elastomeric element 1102 can include complex features 1112 similar to the complex features 312 of FIG. 3 or as described elsewhere herein The complex features 1112 can each include channels 1116 that connect to the outer surface 1108 of the elastomeric element 1102. By having two such complex features 1112, each located between the center of the elastomeric element 1102 and opposite end plates 1104, the complex features 1112 can form a flat portion 1124 of the elastomeric element 1102. During axial compression, the flat portion 1124 can be forced radially outwards (e.g., due to the angled or curved shape of the channels 1116 of the complex features 1112). The position of the complex features 1112 can allow the flat portion 1124 to be radially forced outward without undergoing much, if any, axial compression. The flat portion 1124 can end up contacting the inner diameter of the surrounding tubular. Since the flat portion 1124 does not undergo much, if any, axial compression itself, it can create an improved seal.

The elastomeric element 1102 can include a central recess 1118 in order to induce buckling at a desired location. Additionally, the elastomeric element 1102 can include inner seals 1122. The inner seals 1122 can be o-rings positioned in an inner seal recess 1120. The inner seals 1122 can create a seal between the elastomeric element 1102 and a mandrel positioned within the elastomeric element 1102. During axial compression, the inner seals 1122 can insure no fluid enters the space between the elastomeric element 1102 and the mandrel, such as due to the radial movement of the central recess 1118. In some cases, inner seals can be located at or closer to end plates 1104. In an example, inner seals 1122 can be located within the inner diameter of the end plates 1104, able to create a seal between the end plates 1104 and a mandrel when a mandrel is positioned within the end plates 1104.

The inner seals 1122 can be of any suitable material, including elastomeric materials that are harder or softer than the material of the elastomeric element 1102. In some cases, the inner seals 1122 can be created using additive manufacturing techniques separately of, or with the manufacturing of the elastomeric element 1102. The use of inner seals 1122 can be especially helpful in some designs where the presence of complex features 1112 can reduce the amount of force applied from the elastomeric element 1102 to the mandrel (e.g., where more of the axially compressive force applied to the elastomeric element 1102 is converted to radially outward force).

Figure 12:
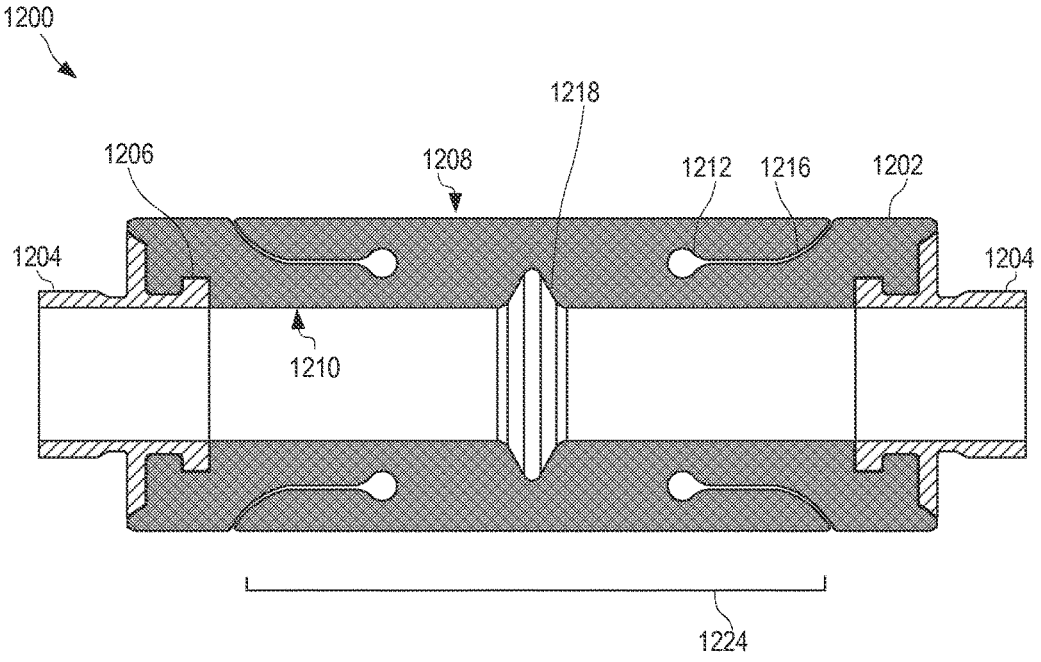
FIG. 12 is a cross-sectional diagram depicting a wellbore sealing device having an elastomeric element with two complex features and a central recess according to certain aspects of the present disclosure.

FIG. 12 is a cross-sectional diagram depicting a wellbore sealing device 1200 having an elastomeric element 1202 with two complex features 1212 and a central recess 1218 according to certain aspects of the present disclosure. The wellbore sealing device 1200 can include an elastomeric element 1202 positioned between a pair of end plates 1204. The end plates 1204 can include a hook feature 1206 that secures the elastomeric element 1202 sufficiently for the end plate 1204 to apply expansion forces (e.g., for the end plates 1204 to pull on the elastomeric element 1202). The elastomeric element 1202 can include an inner surface 1210 having an internal diameter and an outer surface 1208 having an external diameter. The elastomeric element 1202 can include a central recess 1218 in order to induce buckling at a desired location.

The elastomeric element 1202 can include complex features 1212 similar to the complex features 312 of FIG. 3 or as described elsewhere herein The complex features 1212 can each include channels 1216 that connect to the outer surface 1208 of the elastomeric element 1202. By having two such complex features 1212, each located between the center of the elastomeric element 1202 and opposite end plates 1204, the complex features 1212 can form a flat portion 1224 of the elastomeric element 1202. During axial compression, the flat portion 1224 can be forced radially outwards (e.g., due to the angled or curved shape of the channels 1216 of the complex features 1212). The position of the complex features 1212 can allow the flat portion 1224 to be radially forced outward without undergoing much, if any, axial compression. The flat portion 1224 can end up contacting the inner diameter of the surrounding tubular. Since the flat portion 1224 does not undergo much, if any, axial compression itself, it can create an improved seal.

Figure 13:
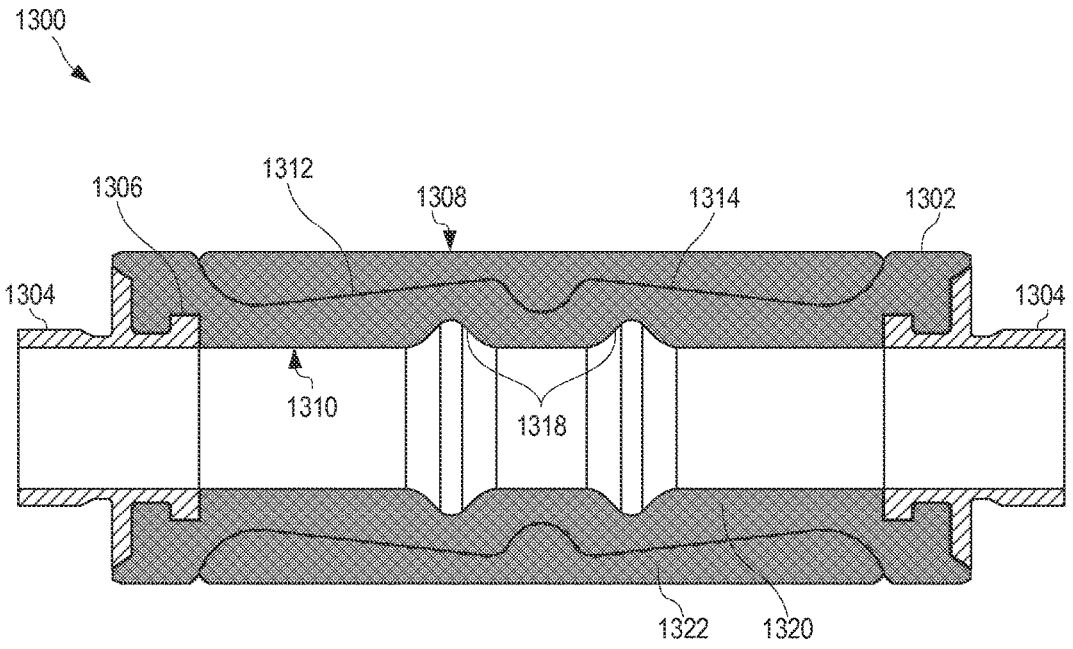
FIG. 13 is a cross-sectional diagram depicting a wellbore sealing device having an elastomeric element with multiple sections according to certain aspects of the present disclosure.

FIG. 13 is a cross-sectional diagram depicting a wellbore sealing device 1300 having an elastomeric element 1302 with multiple sections according to certain aspects of the present disclosure. The wellbore sealing device 1300 can include an elastomeric element 1302 positioned between a pair of end plates 1304. The end plates 1304 can include a hook feature 1306 that secures the elastomeric element 1302 sufficiently for the end plate 1304 to apply expansion forces (e.g., for the end plates 1304 to pull on the elastomeric element 1302). The elastomeric element 1302 can include an inner surface 1310 having an internal diameter and an outer surface 1308 having an external diameter.

The elastomeric element 1302 can include a complex feature 1312 that is in the form of an interface between a first section 1320 and a second section 1322. The complex feature 1312 can include one or more internal voids 1314. The internal voids 1314 can be isolated voids that are not connected to either the inner surface 1310 or the outer surface 1308 of the elastomeric element 1302. The internal voids 1314 can cause the first section 1320 to separate from the second section 1322 in response to axial compressive force. The complex feature 1312 can be shaped to impart outward radial force in response to axial compressive force. The elastomeric element can include zero, one, or more center recesses 1318 to induce buckling or bending in the elastomeric element in order to better separate the second section 1322 from the first section 1320 or cause additional outward radial force in order to force the second section 1322 towards the inner diameter of a surrounding tubular during axial compression of the elastomeric element 1302.

In some cases, the first section 1320 and second section 1322 are formed using the same or different materials. For example, the first section 1320 and second section 1322 can be formed of materials having different hardness values.

Figure 14:
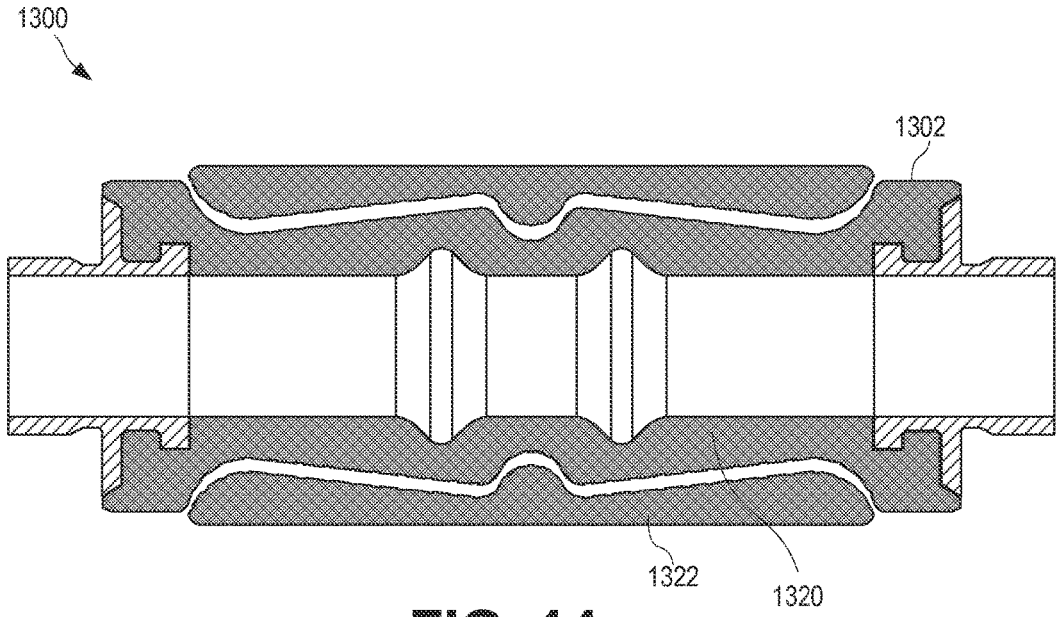
FIG. 14 is a cross-sectional diagram depicting the wellbore sealing device of FIG. 13 with the first section separated from the second section according to certain aspects of the present disclosure

FIG. 14 is a cross-sectional diagram depicting the wellbore sealing device 1300 of FIG. 13 with the first section 1320 separated from the second section 1322 according to certain aspects of the present disclosure. During axial compression, the first section 1320 of the elastomeric element 1302 can separate from the second section 1322, as described herein.

During axial compression, once the second section 1322 separates from the first section 1320, the second section 1322 will not be axially compressed much, if any, but will rather be forced radially outwards towards the surrounding tubular. Since the second section 1322 is not axially compressed much, if any, when in a sealed state, it can form a more favorable seal with the surrounding tubular.

Figure 15:
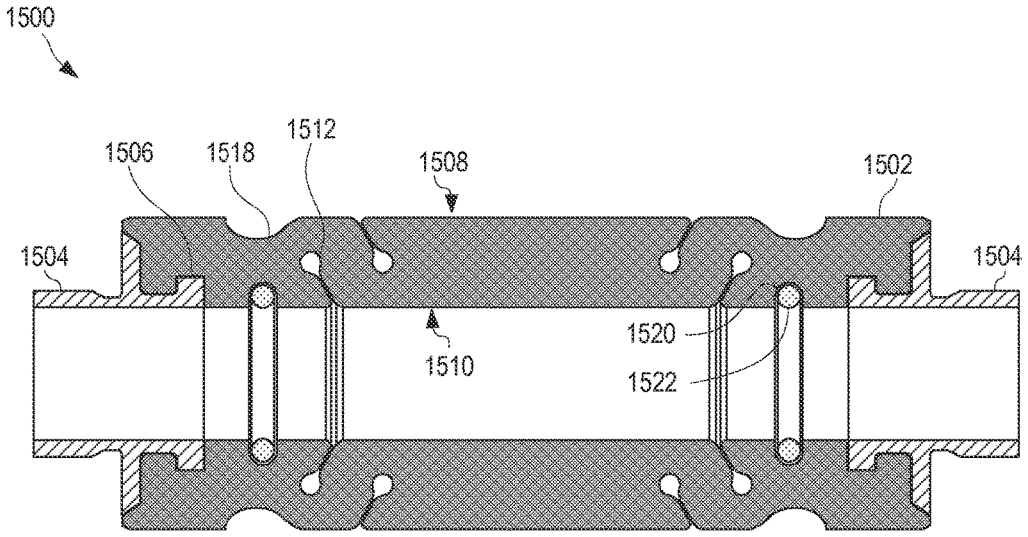
FIG. 15 is a cross-sectional diagram depicting a wellbore sealing device having an elastomeric element with four complex features, two internal seals, and two grooves according to certain aspects of the present disclosure.

FIG. 15 is a cross-sectional diagram depicting a wellbore sealing device 1500 having an elastomeric element 1502 with four complex features 1512, two inner seals 1522, and two grooves 1518 according to certain aspects of the present disclosure. The wellbore sealing device 1500 can include an elastomeric element 1502 positioned between a pair of end plates 1504. The end plates 1504 can include a hook feature 1506 that secures the elastomeric element 1502 sufficiently for the end plate 1504 to apply expansion forces (e.g., for the end plates 1504 to pull on the elastomeric element 1502). The elastomeric element 1502 can include an inner surface 1510 having an internal diameter and an outer surface 1508 having an external diameter.

The elastomeric element 1502 can include complex features 1512 and grooves 1518 similar to complex features 712 and grooves 718 of FIG. 7. The complex features can be arranged to allow portions of the elastomeric element 1502 to move radially outwards without inducing much, if any, stress on the portion of the elastomeric element 1502 closest the end plates 1504. The grooves 1518 can be located adjacent to a void of a complex feature 1512 in order to enhance the hinge effect of the complex feature 1512. In some cases, the grooves 1518 can have a non-symmetrical cross section. For example, the groove 1518 can have a shallow slope on a side near an adjacent complex feature 1512 and a steeper slope on the opposite side. In some cases, the groove 1518 can have a slope that corresponds to the shape of the void of an adjacent complex feature 1512.

The elastomeric element 1502 can include an inner seal 1522 and inner seal recess 1520 similar to the inner seal 1122 and inner seal recess 1120 of FIG. 11.

Figure 16:
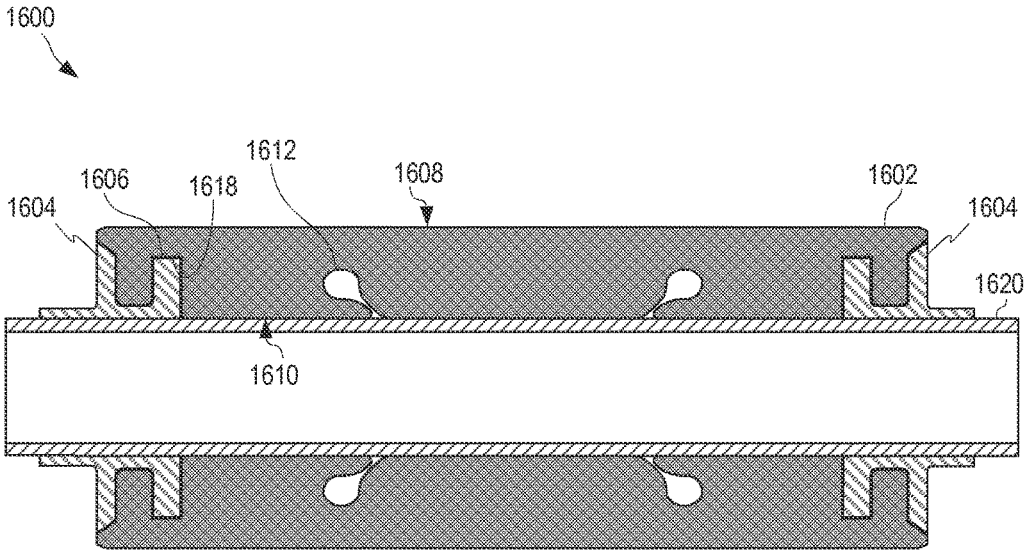
FIG. 16 is a cross-sectional diagram depicting a wellbore sealing device having an elastomeric element that has been manufactured on a mandrel according to certain aspects of the present disclosure.

FIG. 16 is a cross-sectional diagram depicting a wellbore sealing device 1600 having an elastomeric element 1602 that has been manufactured on a mandrel 1620 according to certain aspects of the present disclosure. The wellbore sealing device 1600 can include an elastomeric element 1602 positioned between a pair of end plates 1604 and around the mandrel 1620. The end plates 1604 can include a hook feature 1606 that secures the elastomeric element 1602 sufficiently for the end plate 1604 to apply expansion forces (e.g., for the end plates 1604 to pull on the elastomeric element 1602). The hook feature 1606 can fit within a subterminal recess 1618 of the elastomeric element. The end plates 1604 can be temporarily secured to the mandrel 1620 before manufacturing of the elastomeric element 1602. Since the elastomeric element 1602 has been manufactured directly on the mandrel 1620, such as through additive manufacturing techniques described herein, the elastomeric element 1602 can be positioned on the end plates 1604 without physical manipulation (e.g., stretching). Thus, the hook feature 1606 can extend a relatively long way into the elastomeric element 1602 (e.g., the subterminal recess 1618 of the elastomeric element 1602 can be relatively deep), since the elastomeric element 1602 may not need to stretch over the hook feature 1606. The hook features 1606 can be longer than would otherwise be possible if the elastomeric element 1602 had to be stretched over the hook features 1606 in order to be secured to the end plates 1604. The feature of the elastomeric element 1602 that surrounds the hook feature 1606 can be considered a complex feature that is a complex securement feature. The complex securement feature can be complex (e.g., is impossible or prohibitive to manufacturing using molding, at least because once molded, it cannot be stretched around the end plate 1604 or onto the mandrel 1620 due to its shape) and can be used to secure the elastomeric element 1602 (e.g., securing the elastomeric element 1602 to the end plate 1604 so that axial pulling forces on the end plates 1604 can be used to impart axial pulling forces on the ends of the elastomeric element 1602).

The elastomeric element 1602 can include an inner surface 1610 having an internal diameter and an outer surface 1608 having an external diameter. The inner surface 1610 can be applied directly to the mandrel 1620 during formation of the elastomeric element. The elastomeric element 1602 can include complex features 1612 similar to the complex features 312 of FIG. 3 or as described elsewhere herein.

Figure 17:
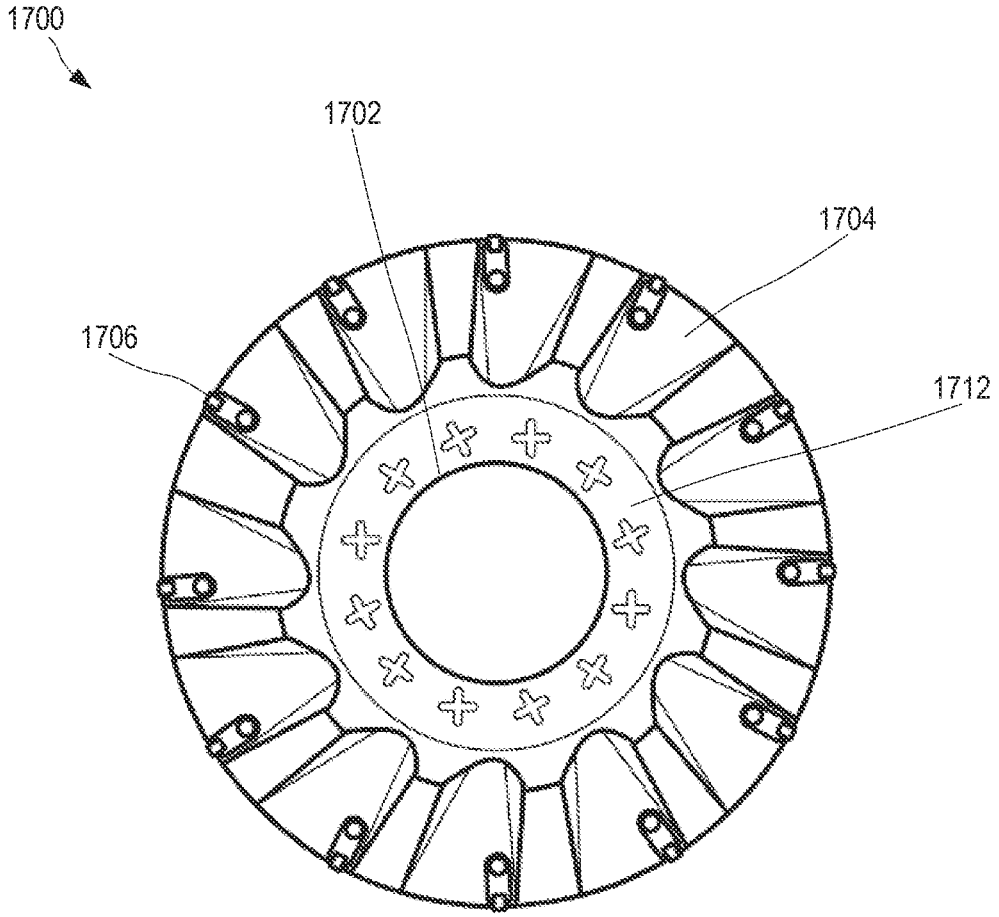
FIG. 17 is an end view of an anti-extrusion device in an expanded state according to certain aspects of the present disclosure.

FIG. 17 is an end view of an anti-extrusion device 1700 in an expanded state according to certain aspects of the present disclosure. The anti-extrusion device 1700 can include a central aperture 1702 through which a mandrel or other tubular may pass. When in an expanded state (e.g., under axial compression), blocking faces 1704 are rotated to be perpendicular to a longitudinal axis of the anti-extrusion device 1700. The blocking faces 1704 block the extrusion element from expanding too far past the end plates, as described herein.

Rollers 1706 can be present on the ends of the blocking faces 1704 adjacent to where the blocking face 1704 would contact or nearly contact the inner diameter of the tubular into which it has been placed. These rollers 1706 can facilitate expansion of the anti-extrusion device 1700. These rollers 1706 can also facilitate positioning of the anti-extrusion device 1700 within the tubular.

Figure 18:
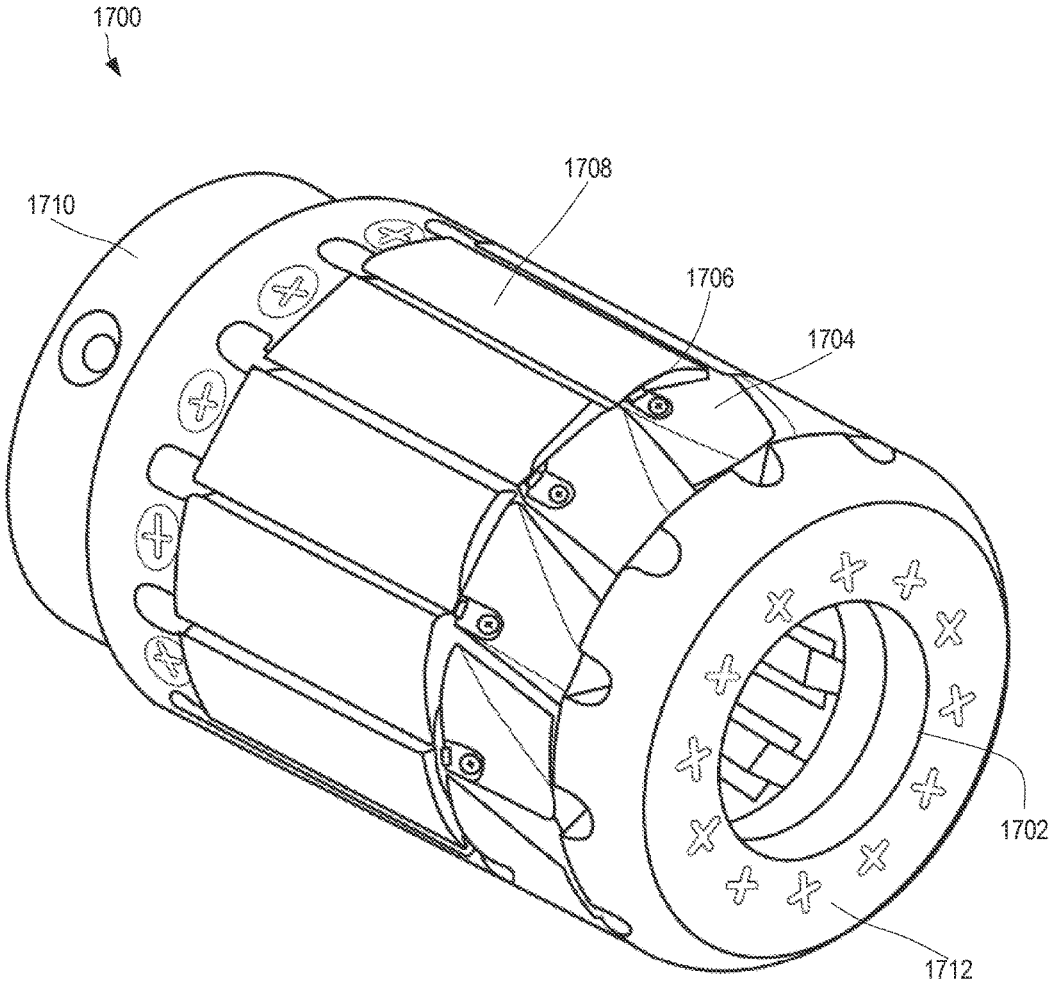
FIG. 18 is an isometric view of the anti-extrusion device of FIG. 17 in a retracted state according to certain aspects of the present disclosure.

FIG. 18 is an isometric view of the anti-extrusion device 1700 of FIG. 17 in a retracted state according to certain aspects of the present disclosure. The anti-extrusion device 1700 can be biased towards a retracted state such that removal of axial compressive forces causes the anti-extrusion device 1700 to move to the retracted state. In some cases, the anti-extrusion device 1700 can be moved to the retracted state by axially pulling forces (e.g., opposite of axially compressive forces) being applied to it.

When in a retracted state, the blocking faces 1704 are moved to a position parallel or approximately parallel to the longitudinal axis of the anti-extrusion device 1700. The rollers 1706, being positioned at the ends of the blocking faces 1704, are thusly retracted away from the inner diameter of the tubular into which the anti-extrusion device 1700 is placed. Longitudinal supports 1708 are shown in a retracted state, parallel or generally parallel to the longitudinal axis of the anti-extrusion device 1700.

When axially compressive forces are applied to the anti-extrusion device 1700, a rear body 1710 is pushed towards a front body 1712. As the rear body 1710 moves towards the front body 1712, the blocking faces 1704 rotate outwards, along with the distal ends of the longitudinal supports 1708, forming a triangular support where the angle between a blocking face 1704 and its longitudinal support 1708 is less than 90°. Under axially compressive forces, the anti-extrusion device 1700 moves from the retracted state of FIG. 18 into the expanded state of FIG. 19.

Figure 19:
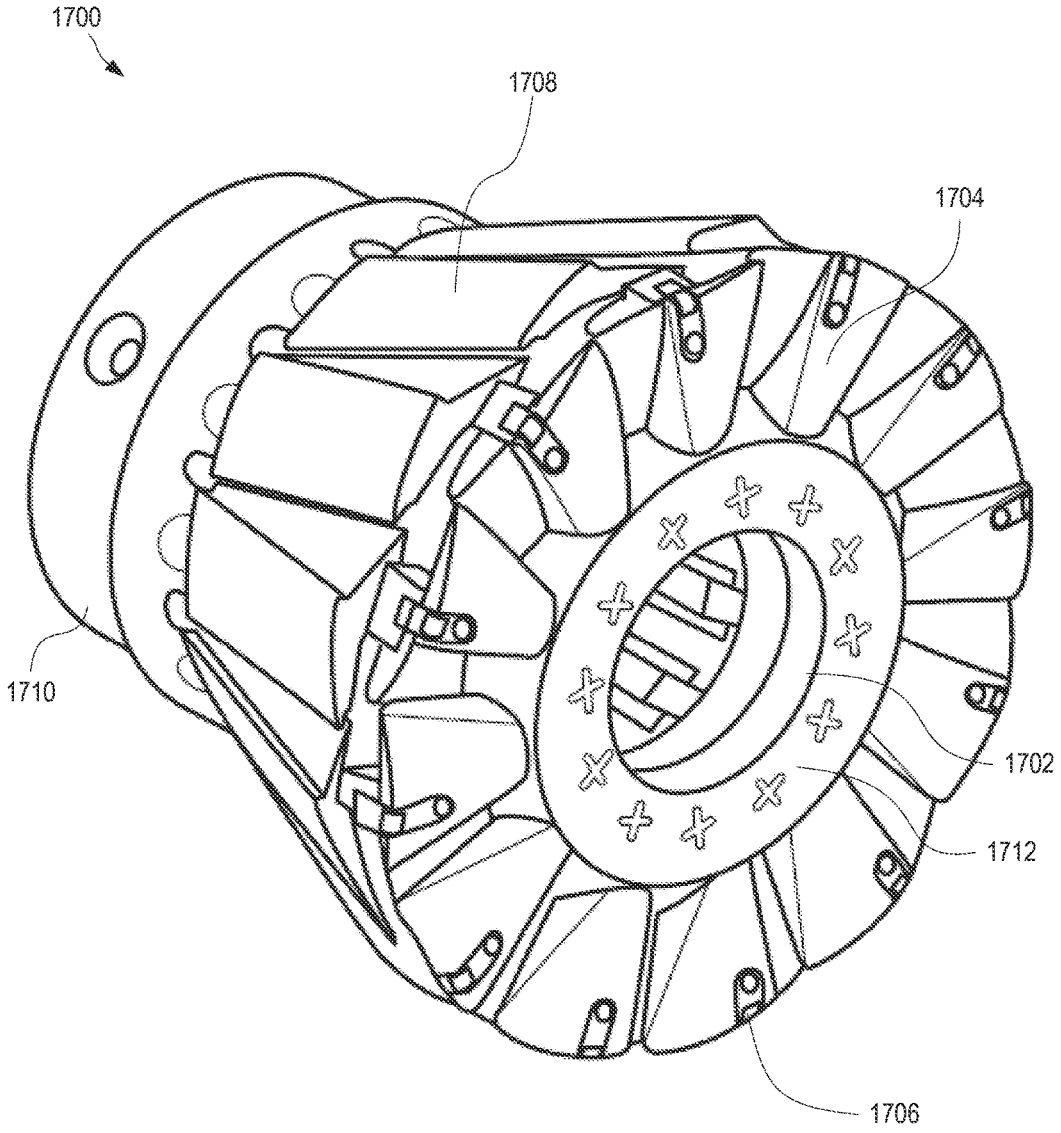
FIG. 19 is an isometric view of the anti-extrusion device of FIG. 17 in an expanded state according to certain aspects of the present disclosure.

FIG. 19 is an isometric view of the anti-extrusion device 1700 of FIG. 17 in an expanded state according to certain aspects of the present disclosure. The blocking faces 1704 are shown extended and available to block extrusion of an elastomeric element. The rollers 1706 are seen at the ends of the blocking faces 1704. The longitudinal supports 1708 are shown supporting the blocking face 1704.

In some cases, one or more rollers 1706 can be positioned on each blocking face 1704 or the distal end of each longitudinal support 1708 such that the roller 1706 is positioned adjacent to the inner diameter of a tubular when the anti-extrusion device 1700 is positioned within a tubular in the expanded state. These rollers 1706 can be uni-axial rollers (e.g., flat rollers) or can be multi-axial rollers (e.g., partially-captured ball bearings).

Figure 20:
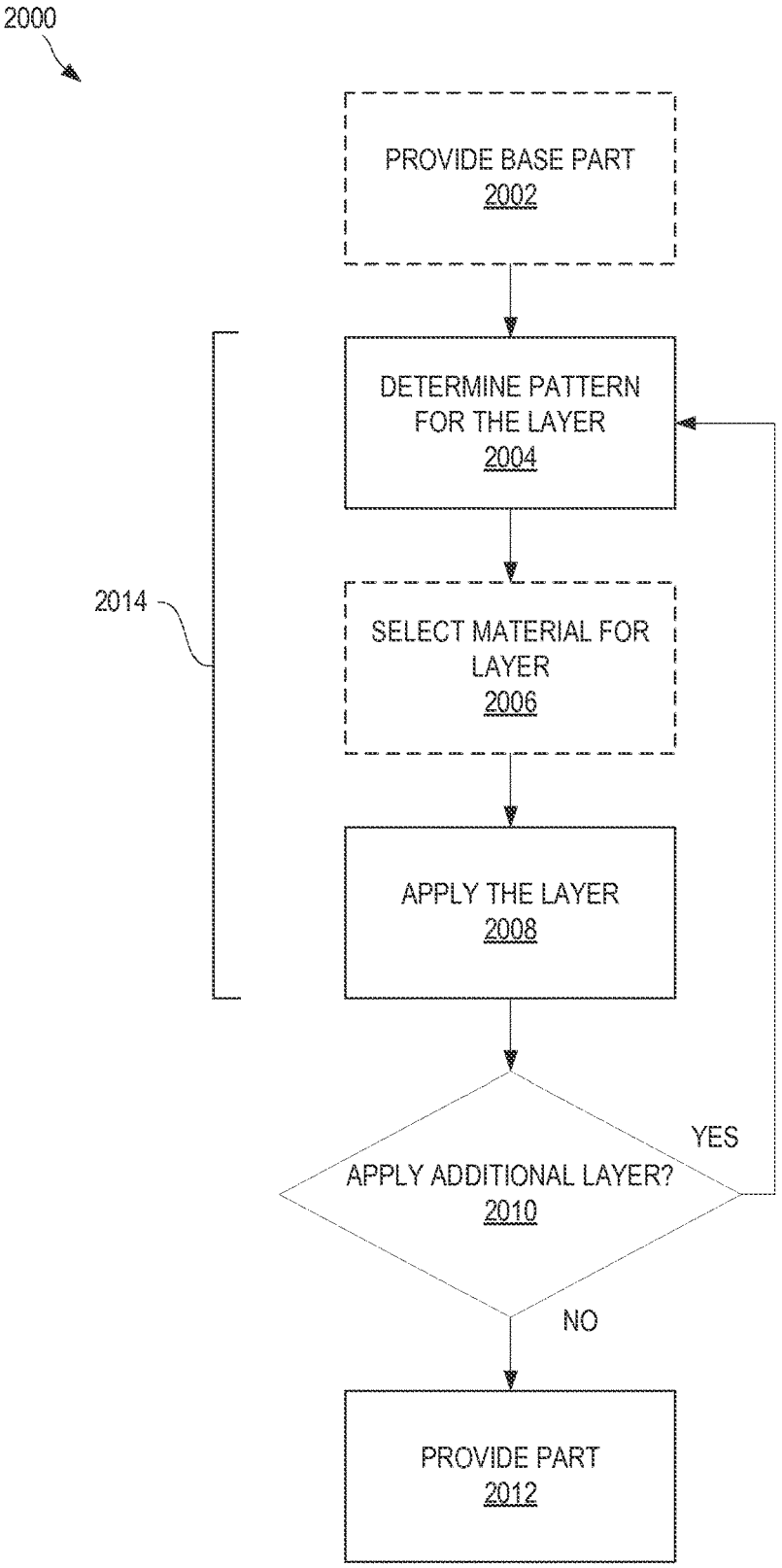
FIG. 20 is a flowchart depicting a process for forming a wellbore sealing apparatus using additive manufacturing techniques according to certain aspects of the present disclosure.

FIG. 20 is a flowchart depicting a process 2000 for forming a wellbore sealing apparatus using additive manufacturing techniques according to certain aspects of the present disclosure. As described herein, and suitable additive manufacturing techniques can be used, allowing for the application of individual layers (e.g., full layers or portions of layers) to be applied sequentially in order to form the full elastomeric element. The elastomeric element can be formed in isolation from other parts of the wellbore sealing apparatus, or can be formed with one or more parts of the wellbore sealing apparatus. For example, the elastomeric element can be formed around the end plates, a mandrel, or any combination thereof.

At optional block 2002 a base part can be provided. The base part can be the mandrel, one or more end plates, or any combination thereof. In some cases, when the elastomeric element is formed in isolation from other parts of the wellbore sealing apparatus, block 2002 may be skipped.

At block 2004, a pattern for the layer of elastomeric material is determined. The layer can be the first layer or any subsequent layer of the elastomeric material, including the final layer. The pattern can include the shape of the layer, including any unfilled sections that will form complex features. As used herein, an "unfilled section" of a layer of elastomeric material is a section of the layer that is not filled with the elastomeric material. In some cases, the unfilled section can be filled with another material, such as a temporary material, described in further detail below.

At optional block 2006, the material for the layer can be selected. The material can be any suitable elastomeric material. As described herein, some elastomeric elements can include two or more sections formed using different elastomeric materials. At optional block 2006, the material to be used for the current layer can be selected, thus allowing the process 2000 to form elastomeric materials having multiple materials. As described herein, the process 2000 can be used to form metallic and other parts as well, in which case the material selected for the layer would be any suitable material for the product (e.g., a metal).

At block 2008, the layer of elastomeric material can be applied. The layer can be applied directly to the base part, to a temporary part (e.g., a part that will be removed from the elastomeric element before the elastomeric element is incorporated into the wellbore sealing apparatus), a building platform (e.g., a surface which can be used to temporarily build the elastomeric element before the elastomeric element is removed to be incorporated into the wellbore sealing apparatus), or a previously applied layer of elastomeric material. A layer can be applied using any suitable method appropriate for the style of additive manufacturing being used.

Blocks 2004, 2006, and 2008 can constitute a layering iteration 2014. Multiple layering iterations 2014 can be used to produce an elastomeric element.

At block 2010, the process 2000 can determine whether an additional layer should be applied. If an additional layer is to be applied, the process 2000 can perform another layering iteration 2014 by continuing at block 2004 to determine the pattern for the additional layer.

When multiple materials are used, two or more sequentially-applied layers may be applied in the same plane as one another, but consisting of differing materials. For example, to produce a single layer having the appearance of a filled-in circle of a first material within a square field of a second material, a first layering iteration 2014 can be performed to apply the first material in the circular shape, and a second layering iteration 2014 can be performed to apply the second material in the square shape. Thus, at block 2008, if the current layer is being applied to a previously applied layer of elastomeric material, the current layer does not necessarily need to be applied to the layer that was applied in the immediately-previous iteration, but can be applied to a layer that was previously applied two or more iterations ago.

At block 2010, if the process 2000 determines that no additional layers need be applied, the part can be provided at block 2012. Providing the part can include providing the elastomeric element or any other part or combination of parts formed using process 2000. Providing the part can include performing further assembly of the part with one or more other parts. Providing the part can include providing the part to another process or additional steps not shown in process 2000. In some cases, providing the part can include performing additional finishing, such as additional finishing of the elastomeric element. For example, additional finishing can include surface polishing or texturization, or even subsequent machining Providing the part can be providing the part for use, such as use in a wellbore or tubular.

In some cases, finishing steps (e.g., machining) can occur between sequential layering iterations 2014. For example, voids can be formed by applying a full layer (e.g., without unfilled areas) of elastomeric material and then machining out an unfilled area. After multiple iterations 2014, the machined-out unfilled areas can form a void in the elastomeric element.

Process 2000 describes how an elastomeric element can be formed through sequential layering iterations 2014. The layering iterations 2014 can form the elastomeric element in any suitable orientation. For example, each layer of the elastomeric element can be generally cylindrical in shape, growing in diameter for subsequent layers. In another example, each layer can be generally annular or ring-like in shape, with each layer being perpendicular to the longitudinal axis of the elastomeric element (e.g., the elastomeric element 302 of FIG. 3 if it were formed using consecutive layers from left to right). Other layer orientations can be used.

In some cases, a layering iteration 2014 can include applying a layer of a temporary material. The temporary material can be any material able to be easily removed from the elastomeric element without damage to the elastomeric element. For example, the temporary material can be a material having a melting point lower than the elastomeric element. In some cases, the temporary material can be a water-soluble material or loosely-bound material capable of being washed away from the elastomeric element. The temporary material can be applied in a layering iteration 2014 in order to provide temporary structural support for subsequent layers applied in subsequent layering iterations 2014. Once the elastomeric element has been formed, a finishing operation can include removing any temporary material, thus leaving voids or channels wherever the temporary material was used.

The foregoing description of the various aspects of the present disclosure, including illustrated embodiments, has been presented only for the purpose of illustration and description and is not intended to be exhaustive or limiting to the precise forms disclosed. Numerous modifications, adaptations, and uses thereof will be apparent to those skilled in the art.

As used below, any reference to a series of examples is to be understood as a reference to each of those examples disjunctively (e.g., "Examples 1-4" is to be understood as "Examples 1, 2, 3, or 4").

Example 1 is a wellbore sealing apparatus comprising an elastomeric element axially compressible between an uncompressed state and a compressed state, the elastomeric element being axially positionable within an annulus in the uncompressed state and being expandable for fluidly sealing the annulus in the compressed state, the elastomeric element including an internal void. The elastomeric element can be formed using additive manufacturing.

Example 2 is the apparatus of example 1, wherein the elastomeric element includes a channel connecting the internal void to an inner surface or an outer surface of the elastomeric element, and wherein the internal void has a width larger than a width of the channel.

Example 3 is the apparatus of example 2, wherein the channel is positioned to induce radial force in the elastomeric element in response to axial compressive force to the elastomeric element.

Example 4 is the apparatus of examples 1-3, wherein the elastomeric element further includes a groove in the outer surface of the elastomeric element adjacent to the internal void.

Example 5 is the apparatus of examples 1 or 4, wherein the internal void is isolated from an inner surface or outer surface of the elastomeric element.

Example 6 is the apparatus of examples 1-5, wherein the internal void is positioned between a first section of the elastomeric element and a second section of the elastomeric element to facilitate separation of the first section from the second section in response to axial compression of the elastomeric element.

Example 7 is the apparatus of examples 1-6, wherein the elastomeric element includes a plurality of layers of elastomeric material formed over one another using an additive manufacturing technique, wherein a subset of the plurality of layers includes unfilled sections that form the internal void.

Example 8 is a method of producing a wellbore sealing device, comprising providing a tubular having an outer surface; and forming an elastomeric element about the tubular, wherein forming the elastomeric element includes applying consecutive layers of elastomeric material to the outer surface of the tubular; and forming an internal void in the elastomeric element, wherein forming the internal void includes leaving unfilled sections in at least some of the consecutive layers of elastomeric material.

Example 9 is the method of example 8, wherein forming the elastomeric element further includes forming a channel connecting the internal void to an inner surface or an outer surface of the elastomeric element, wherein the internal void has a width larger than a width of the channel.

Example 10 is the method of examples 8 or 9, wherein the internal void is positioned between a first section of the elastomeric element and a second section of the elastomeric element to facilitate separation of the first section from the second section in response to axial compression of the elastomeric element.

Example 11 is the method of examples 8-10, wherein applying the consecutive layers of elastomeric material includes applying a layer of a first elastomeric material and applying a layer of a second elastomeric material that is different than the first elastomeric material.

Example 12 is the method of examples 8-11, wherein providing the tubular further includes forming the tubular, and wherein forming the tubular includes applying a layer of material to another layer of material.

Example 13 is an apparatus positionable in a downhole environment, comprising a mandrel having an outer diameter, the mandrel positionable within an inner diameter of a tubular or a wellbore for forming an annulus between the outer diameter of the mandrel and the inner diameter of the tubular or the wellbore; an elastomeric element positionable around the outer diameter of the mandrel, the elastomeric element being axially compressible between an uncompressed state and a compressed state, the elastomeric element being axially positionable within the annulus in the uncompressed state and being expandable for fluidly sealing the annulus in the compressed state, the elastomeric element including an internal void; and a pair of end plates positionable around the outer diameter of the mandrel at opposing ends of the elastomeric element for applying axial compressive force to the elastomeric element.

Example 14 is the apparatus of example 13, wherein the elastomeric element includes a channel connecting the internal void to an inner surface or an outer surface of the elastomeric element, and wherein the internal void has a width larger than a width of the channel.

Example 15 is the apparatus of example 14, wherein the channel is positioned to induce radial force in the elastomeric element in response to application of the axial compressive force to the elastomeric element.

Example 16 is the apparatus of examples 13-15, wherein the elastomeric element further includes a groove in the outer surface of the elastomeric element adjacent to the internal void.

Example 17 is the apparatus of examples 13 or 16, wherein the internal void is isolated from an inner surface or outer surface of the elastomeric element.

Example 18 is the apparatus of examples 13-17, wherein the internal void is positioned between a first section of the elastomeric element and a second section of the elastomeric element to facilitate separation of the first section from the second section in response to axial compression of the elastomeric element.

Example 19 is the apparatus of examples 13-18, wherein the elastomeric element includes a plurality of layers of elastomeric material formed over one another using an additive manufacturing technique, wherein a subset of the plurality of layers includes unfilled sections that form the internal void.

Example 20 is the apparatus of example 19, wherein the additive manufacturing technique is selected from the group consisting of three-dimensional printing, fused filament fabrication, selective heat sintering, fused deposition modeling, and selective laser sintering.

What is claimed is:

1. A wellbore sealing apparatus, comprising:

an elastomeric element axially compressible between an uncompressed state and a compressed state, the elastomeric element being axially positionable within an annulus in the uncompressed state and being expandable for fluidly sealing the annulus in the compressed state, the elastomeric element including an internal void and a channel connected between the internal void and an internal surface of the elastomeric element, the channel being positioned to create an inclined plane capable of converting axially compressive force into outwards radial force;

wherein the internal void and the channel are both formed within the elastomeric material of the elastomeric element.

2. The apparatus of claim 1, wherein a width of the internal void is at least twice a width of the channel.

3. The apparatus of claim 2, wherein the width of the internal void is at least four times the width of the channel.

4. The apparatus of claim 3, wherein the elastomeric element further includes a groove in the outer surface of the elastomeric element adjacent to the internal void.

5. The apparatus of claim 1, wherein the internal void is isolated from an inner surface or outer surface of the elastomeric element.

6. The apparatus of claim 5, wherein the internal void is positioned between a first section of the elastomeric element and a second section of the elastomeric element to facilitate separation of the first section from the second section in response to axial compression of the elastomeric element.

7. The apparatus of claim 1, wherein the elastomeric element includes a plurality of layers of elastomeric material formed over one another using an additive manufacturing technique, wherein a subset of the plurality of layers includes unfilled sections that form the internal void.

8. A method of producing a wellbore sealing device, comprising:

providing a tubular having an outer surface; and forming an elastomeric element about the tubular, wherein forming the elastomeric element includes:

applying consecutive layers of elastomeric material to the outer surface of the tubular; and forming an internal void and a channel connected between the internal void and an internal surface of the elastomeric element, wherein forming the internal void and the channel includes leaving unfilled sections in at least some of the consecutive layers of elastomeric material, the channel being positioned to create an inclined plane capable of converting axially compressive force into outwards radial force;

wherein the internal void and the channel are both formed within the elastomeric material of the elastomeric element.

9. The method of claim 8, wherein forming the elastomeric element further includes forming a channel connecting the internal void to an inner surface or an outer surface of the elastomeric element, a width of the internal void is at least twice a width of the channel.

10. The method of claim 8, wherein the internal void is positioned between a first section of the elastomeric element and a second section of the elastomeric element to facilitate separation of the first section from the second section in response to axial compression of the elastomeric element.

11. The method of claim 8, wherein applying the consecutive layers of elastomeric material includes applying a layer of a first elastomeric material and applying a layer of a second elastomeric material that is different than the first elastomeric material.

12. The method of claim 8, wherein providing the tubular further includes forming the tubular, and wherein forming the tubular includes applying a layer of material to another layer of material.

13. An apparatus positionable in a downhole environment, comprising:

a mandrel having an outer diameter, the mandrel positionable within an inner diameter of a tubular or a wellbore for forming an annulus between the outer diameter of the mandrel and the inner diameter of the tubular or the wellbore;

an elastomeric element positionable around the outer diameter of the mandrel, the elastomeric element being axially compressible between an uncompressed state and a compressed state, the elastomeric element being axially positionable within the annulus in the uncompressed state and being expandable for fluidly sealing the annulus in the compressed state, the elastomeric element including an internal void and a channel connected between the internal void and an internal surface of the elastomeric element, the channel being positioned to create an inclined plane capable of converting axially compressive force into outwards radial force, wherein the internal void and the channel are both formed within the elastomeric material of the elastomeric element; and a pair of end plates positionable around the outer diameter of the mandrel at opposing ends of the elastomeric element for applying axial compressive force to the elastomeric element.

14. The apparatus of claim 13, wherein a width of the internal void is at least twice a width of the channel.

15. The apparatus of claim 14, wherein the width of the internal void is at least four times the width of the channel.

16. The apparatus of claim 15, wherein the elastomeric element further includes a groove in the outer surface of the elastomeric element adjacent to the internal void.

17. The apparatus of claim 13, wherein the internal void is isolated from an inner surface or outer surface of the elastomeric element.

18. The apparatus of claim 17, wherein the internal void is positioned between a first section of the elastomeric element and a second section of the elastomeric element to facilitate separation of the first section from the second section in response to axial compression of the elastomeric element.

19. The apparatus of claim 13, wherein the elastomeric element includes a plurality of layers of elastomeric material formed over one another using an additive manufacturing technique, wherein a subset of the plurality of layers includes unfilled sections that form the internal void.

20. The apparatus of claim 19, wherein the elastomeric element is formed using an additive manufacturing technique selected from the group consisting of three-dimensional printing, fused filament fabrication, selective heat sintering, fused deposition modeling, and selective laser sintering.

* * * * *